United States Patent [19]

Parker et al.

[11] Patent Number: 5,052,873

[45] Date of Patent: Oct. 1, 1991

[54] APPARATUS AND METHOD OF BINDING A BOOK

[76] Inventors: Kevin P. Parker, 830 Isabella St., Oakland, Calif. 94607; Eugene E. Anderson, 100 Buckeye, Oakland, Calif. 94618; Leo M. Fernekes, 110 W. 26th St., #713, New York, N.Y. 10001

[21] Appl. No.: 509,027

[22] Filed: May 10, 1990

Related U.S. Application Data

[63] Continuation of Ser. No. 350,041, May 10, 1989, abandoned.

[51] Int. Cl.[5] ..... B42C 13/04

[52] U.S. Cl. ..... 412/13; 412/36; 412/37

[58] Field of Search ..... 412/8, 9, 11, 37, 902, 412/13, 36, 27, 900; 156/908; 281/21.1

[56] References Cited

U.S. PATENT DOCUMENTS

| | | | |
|---|---|---|---|
| 3,531,358 | 9/1970 | Rost | 412/37 |
| 3,715,260 | 2/1973 | Dornemann | 412/36 |
| 3,911,517 | 10/1975 | Davis | 412/37 |
| 3,928,119 | 12/1975 | Sarring | 412/37 |
| 4,151,037 | 4/1979 | Klingelhoefer | 412/27 |
| 4,496,617 | 1/1985 | Parker | 412/37 |
| 4,531,874 | 7/1985 | Voges | 412/37 |
| 4,552,497 | 11/1985 | Kockler | 412/36 |

*Primary Examiner*—Paul A. Bell

*Attorney, Agent, or Firm*—Limbach, Limbach & Sutton

[57] ABSTRACT

Apparatus and method for binding a book utilizing a binding tap having a flexible substrate and a heat activated adhesive. The binding tape is forced against the front cover of the book utilizing a heated platen, so as to form a front cover seal simultaneously along the length of the front cover. The platen then folds the tape around the edge of the book so as to form the spine of the book. The platen then forces the remaining portion of the tape against the back cover so as to form a back cover seal simultaneously along the length of the back cover.

42 Claims, 25 Drawing Sheets

APPARATUS AND METHOD OF BINDING A BOOK

This is a continuation of application Ser. No. 350,041, filed May 10, 1989, now abandoned.

BACKGROUND OF THE INVENTION

1. Field of the Invention

The present invention relates generally to the field of apparatus for binding a book and more particulary, to automatic bookbinding apparatus which utilize a binding tape comprised of a substrate which carries an adhesive.

2. Description of Related Art

Apparatus for binding books utilizing a binding tape carrying heat and/or pressure actuated adhesives are well known. For example, U.S. Pat. Nos. 3,928,119 and 3,911,517 disclose a bookbinding machine for binding a stack of sheets. The stack of sheets to be bound is first positioned on a movable plate and clamped between a pair of guides. A binding tape is positioned under the movable plate, below the spine of the book. The binding tape is supported intermediate two moveable heated platens and above a fixed heated platen.

Once the book is positioned, the moveable plate is moved away from the book and the book is translated downward, towards the binding strip. The spine of the book engages the binding strip and forces the strip down between the two moveable heated platen until the center of the strip contacts the fixed heated platen. The moveable heated platens are positioned apart a distance slightly greater than the width of the book so that the periphery of the binding tape will fold over the front and rear book covers.

The moveable platens are then forced together so as to seal the periphery of the binding strip to the front and back cover sheets using heat and pressure. The fixed heated platen functions to melt the central binding tape adhesive so as to wet the spine of the book (the edges of the sheet) with adhesive. The moveable platens are then retracted and the bound book is removed and permitted to cool.

A further bookbinding apparatus is disclosed in U.S. Pat. No. 3,531,358. The stack of sheets to be bound is gripped between a pair of opposing clamps. A binding tape having heat and pressure sensitive adhesive is positioned on top of a pair of heated moveable platens. The stack is then lowered on the binding tape so that molten adhesive contacts the edges of the sheets.

The pair of opposing platens then separate a distance slightly wider than the stack and the stack is forced down between the opposing platens thereby causing the peripheries of the binding tape to fold up against the front and back covers of the stack. The opposing platens are then forced against the stack so as to seal the tape to the covers. The platens are then opened so that the bound book may be removed.

A principal disadvantage of the bookbinding apparatus of the type previously discussed is that such apparatus are not capable of reliably binding relatively thin books. In each case, the folding of the binding tape is accomplished by exerting force through the stack or book itself. If the stack is thin, the stack does not have sufficient rigidity to fold the tape. This is especially true in the event a binding tape having relatively thick adhesives is used, since such tapes are somewhat rigid and do not fold as readily as other types of tapes.

The present invention overcomes the above-noted shortcoming of conventional bookbinding apparatus. Because the book is substantially supported throughout the binding sequence, books of narrow thickness can be reliably bound. This and other advantages of the subject invention will become apparent to those skilled in the art upon reading the following Best Mode of Carrying Out the Invention together with the drawings.

SUMMARY OF THE INVENTION

Apparatus and method for binding a plurality of sheets arranged in a stack are disclosed. A binding tape which includes a flexible tap substrate having an adhesive is utilized. The adhesive is preferably heat activated, although pressure sensitive adhesives can also be used.

The apparatus includes means for supporting the stack of sheets. Preferably, the support means includes a pair of clamps which grip the stack. The binding tape is positioned relative to the stack utilizing a tape positioner means.

Platen means is also provided for applying the tape to the stack of sheets. The platen means, and stack support means are controlled by a control means, such as a microprocessor. The control means causes the relative positions of the stack support means and platen means to be such that the tape is applied under pressure to form a first seal on the first cover of the stack. The first cover seal is made substantially simultaneously along the entire length of the first cover. The control means also causes the relative positions of the stack support means and the platen means to be such that binding tape is sealed to the second cover of the stack by application of pressure. The second cover seal is also made substantially simultaneously along the entire length of the second cover.

DETAILED DESCRIPTION OF THE PREFERRED EMBODIMENT

Figure 1:
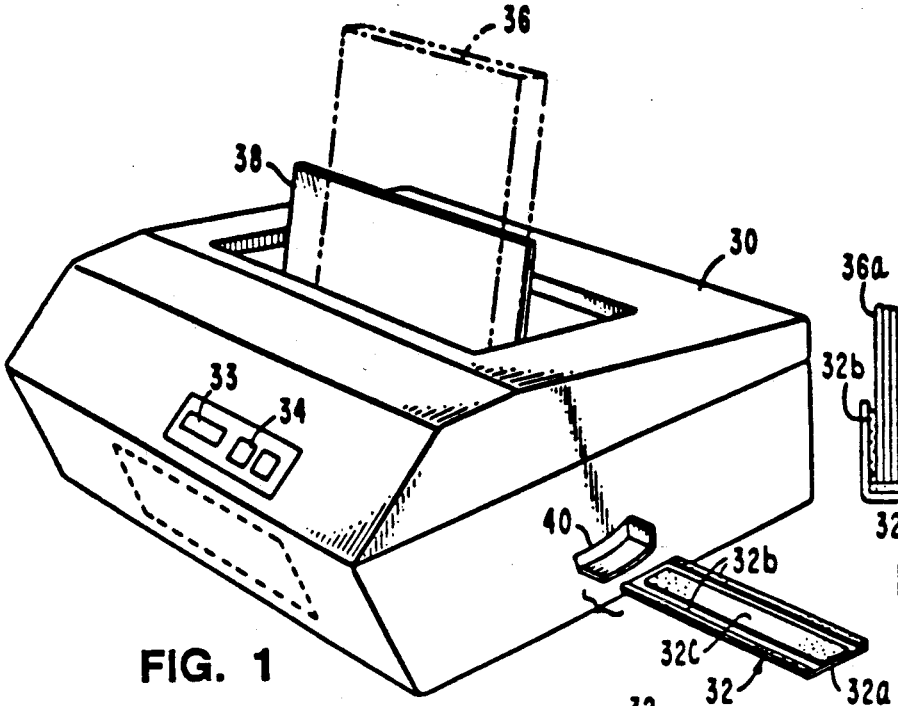
FIG. 1 is a perspective view of the subject binding apparatus showing the housing and a thick binding tape to be used for binding a thick book.

Referring now to the drawings, FIG. 1 shows the subject binding apparatus enclosed in a housing 30. Housing 30 includes a control panel having a display 32 and control buttons 34 to be used by the operator.

Housing 30 is provided with a large opening on the top panel for receiving a book 36 to be bound or edited. The term book as used here is intended to mean a collection or stack of sheets, either bound or unbound. The subject apparatus includes a book guide 38 for supporting the book during the binding or editing sequence.

An opening 40 is formed in housing 30 for receiving a binding tape, generally designated by the numeral 32. Details regarding to construction of the binding tape 32 are disclosed in U.S. Pat. No. 4,496,617, the contents of which are hereby incorporated by reference. The operator preferably stands in front of the machine, with tape opening 40 located to the right. For purposes of the present description of the invention, motion towards the operator is forward motion and motion away from the operator is rearward motion.

Figure 2:
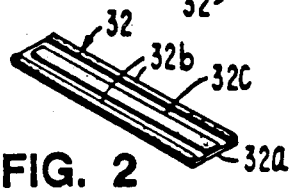
FIG. 2 is a perspective view of a narrow binding tape of the type to be used in the subject binding apparatus.

Binding tape 32, also depicted in FIG. 2, includes a flexible substrate 32*a* having a length which is equal to the length of the book to be bound and a width which is substantially greater than the thickness of the book to be bound. A pair of narrow outer adhesive strips 32*b* are formed along the periphery of substrate 32*c*, for making contact with the front and back sheets of the book which will form the front and back book covers. A wide central adhesive strip 32*c* is formed intermediate the peripheral strips 32*b* for contacting the edges of the book sheets so as to form the spine of the book.

Peripheral adhesive strips 32*b* are preferably a high tack, heat activated adhesive having high viscosity. Central adhesive strip 32*c* is preferably a low tack heat activated adhesive. The central adhesive should be of low viscosity to ensure that the edges of the pages to be bound are thoroughly wetted by the adhesive.

Figure 3:
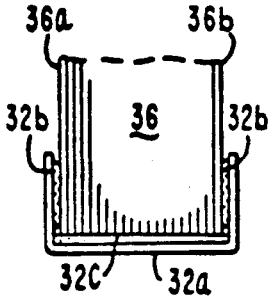
FIG. 3 is an elevated cross-sectional view of a relatively thick bound book using the wide binding tape of FIG. 1.

FIG. 3 shows a section of a book bound utilizing the wide width binding tape 32 of FIG. 1. The substrate 32*a* extends around the edge of the bound pages, with the peripheral high tack adhesive strips 32*b* securing the substrate to the front and back sheets 36*a* and 36*b*, respectively, which form the front and back covers. The central, low viscosity adhesive 32*c* wets the edges of the remaining sheets thereby securing the sheets to the substrate so as to form an integral bound book.

Figure 4:
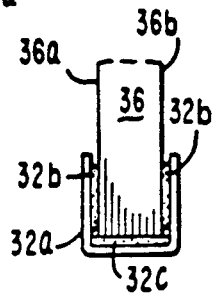
FIG. 4 is an elevated cross-sectional view of a relatively thin bound book using a binding tape depicted in FIG. 2.

FIG. 4 shows a bound book which is substantially thinner than the book of FIG. 3. A narrow width binding tape is used as shown in FIG. 2. Intermediate or medium width binding tape is preferably used for books of medium width.

As will be described later in greater detail, the subject binding apparatus binds a book by first gripping the book to be bound. A seal is formed between the unfolded binding tape by applying one of the peripheral adhesive strips 32*b* to sheet 36*b* which will be the back cover of the book. Both pressure and heat are used to effect the seal. The position of the seal on the back cover will depend on the thickness of the book with respect to the width of the tape. The thicker the book the lower the first seal on the back cover 36*b*.

Once the first seal is formed, the substrate is folded at a right angle so that the central adhesive strip 32*c* will contact the edges of the sheets which form the book. Heat and pressure are applied for several seconds so as to melt the central adhesive and thoroughly wet the edges of the sheets. Next, the substrate is folded a second time so that the remaining peripheral adhesive strip 32*b* will come into contact with sheet 32*a* which will for front cover of the book. Heat and pressure are applied to form the second seal, thereby completing the binding sequence.

Figures 8, 9A, 9B:
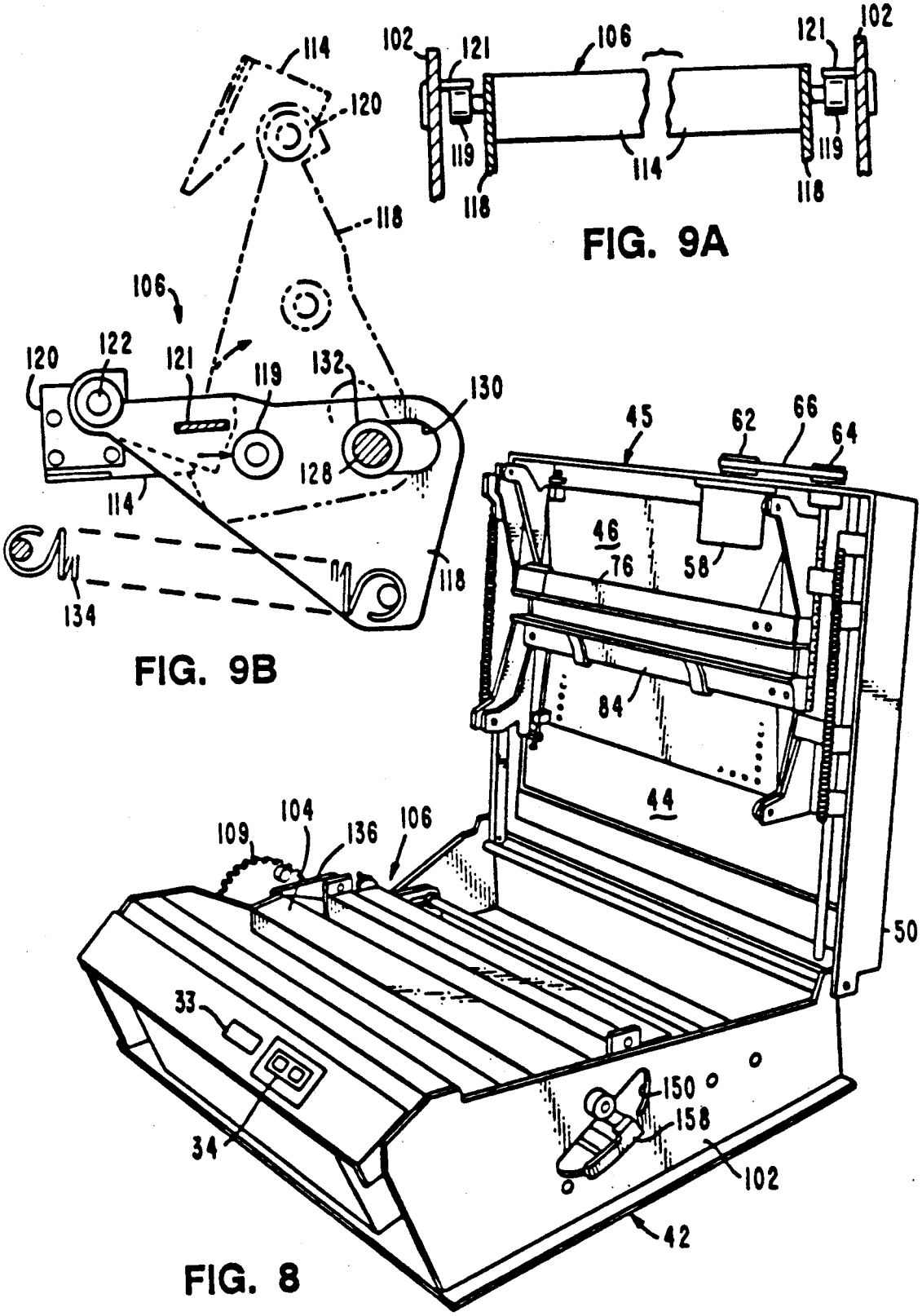
FIG. 8 is an elevated cross-sectional view showing the carriage assembly of the subject binding apparatus rotated upwards to an open position.
FIG. 9A is a front cross-sectional view of the movable platen assembly in the operating position with the assembly held down by the stop brackets.
FIG. 9B is a side view of the movable platen assembly in the operating position and in the open position (in phantom).
Figure 10:
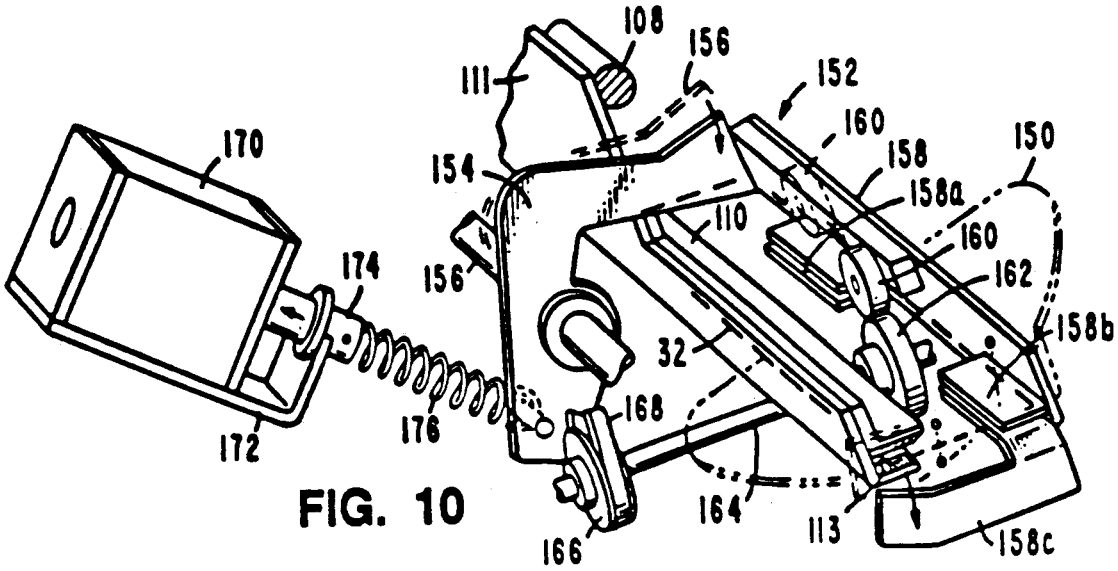
FIG. 10 is a cutaway view of the binding tape feed mechanism of subject binding apparatus.

FIG. 8 shows some of the details of the construction of the subject binding apparatus. Housing 30 is removed to disclose a lower base assembly, generally designated by the numeral 42, and an upper carriage assembly, generally designated by the numeral 45. The carriage assembly 45, which includes a carriage frame 50, is pivotally mounted on the base assembly 42 and is shown pivoted up in an open position to facilitate servicing.

Figure 6:
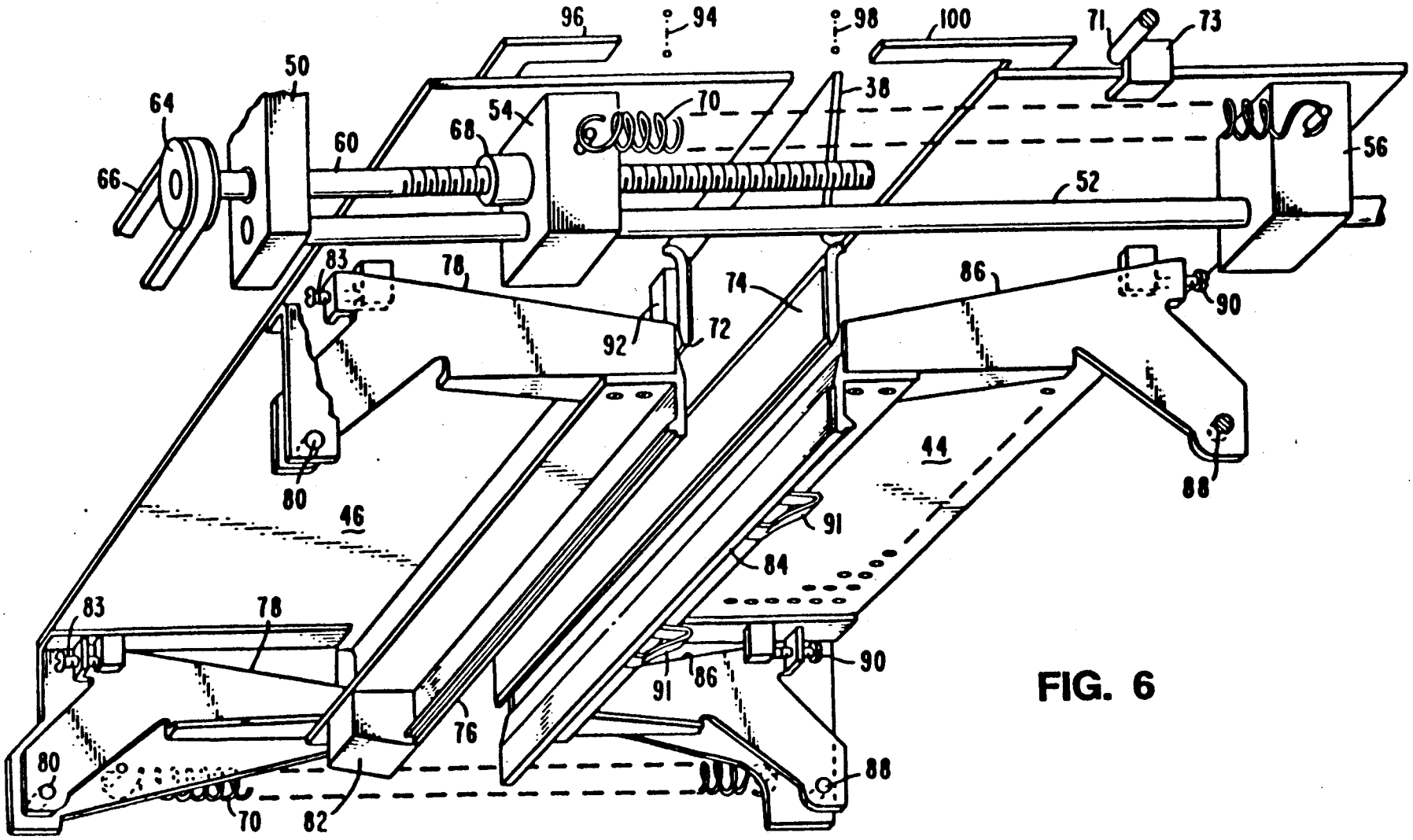
FIG. 6 is an elevational perspective view of the underside of the carriage assembly of the subject binding apparatus showing key elements, including the front and rear clamps, the front and rear backup bars and the lead screw for driving the clamps.

Further details of the carriage assembly 45 are shown in FIG. 6. The carriage assembly includes a front clamp 46 and a rear clamp 44, both of which are mounted for movement on the carriage frame 50 (FIG. 8). Front and rear clamps 46 and 44 are independently guided on guide shaft 52 which is mounted on carriage frame 50. Guide shaft 52 extends through openings in mounting block 54 secured to front clamp 46 and in mounting block 56 secured to rear clamp 44. The bearing for supporting guide blocks 54 and 56 are not depicted.

The carriage assembly includes a carriage drive motor 58 (FIG. 8) mounted on frame 50 for driving the front and rear clamps. Motor 58 is a conventional stepping motor. Motor 58 drives a lead screw 60 by way of pulleys 62 and 64 and drive belt 66. Pulley 64 (FIG. 6) is mounted on lead screw 66, with lead screw 60 engaging a drive nut 68 secured to mounting block 54 of the front clamp. Thus, front clamp 46 may be driven directly in either a forward or reverse direction by motor 58.

The rear clamp 44 is coupled to the front clamp 46 by way of a pair of clamp springs 70. Springs 70 tend to force the two clamps together so as to grip a book positioned intermediate the clamps. As will be described in greater detail, the front and rear clamps function generally to grip the book and translate the book horizontally during the binding sequence.

A boss 71 is mounted on carriage frame 50 to limit movement of rear clamp 44 in the forward direction (towards the operator). Rear clamp 44 carries a stop member 73 which limits movement in the forward direction when the member engages boss 71. Boss 71 and stop member 73 cause the rear clamp 44 to separate from the front clamp 46 so that a book may be inserted between the two clamps.

Front clamp 46 and rear clamp 44 include vertical grip members 72 and 74, respectively, for gripping the book to be bound. The surface of the grip members is preferably covered with a textured coating to prevent the book from slipping during the binding sequence.

A front backup bar 76 is mounted on front clamp 46 by way of support arms 78. Support arms 78 are pivotally mounted on the underside of the front clamp by way of pivot pins and bearings 80. A front cam shoe 82 is secured to the front backup bar 76. Front cam shoe 82 engages a rotating platen, to be described later, which causes the front back up bar to pivot between an engaged position wherein the bar is contacting the book to be bound and a non-engaged position where the bar is displaced from the book. Sets screws 83 are provided for adjusting the position of the front backup bar when in the engaged position.

A rear back up bar 84 is mounted on rear clamp 44 by way of support arms 86. Support arms 86 are pivotally mounted on the underside of rear clamp 44 by way of pivot pins and bearings 88. A pair of rear cam shoes 91 is secured to the rear backup bar 84. Cam shoes 90 engage a rotating platen, as will be described, which causes the bar to pivot from an engaged position contacting the book to be bound to a non-engaged position displaced from the book. Set screws 90 are provided for adjusting the position of the rear backup bar when in the engaged position.

The carriage assembly 45 includes three optical sensors, including a book sensor 92 mounted on the right extreme edge of front grip member 72. Sensor 92 is preferably a reflective optical sensor wherein a light emitting diode is positioned adjacent a photo-transistor. The sensor is actuated when a reflective surface such as a book, reflects light from the diode back to the photo-transistor. Book sensor 92 will be actuated when the user has properly placed a book between the front and rear grip members 72 and 74, as will be described.

A carriage home sensor 94 is mounted on carriage frame 50 for sensing when front clamp 46 is in the home position. Sensor 94 is a slot type optical sensor having light emitting diode spaced apart from and facing a photo-transistor. The photo-transistor will be normally illuminated by the diode until an element such as a flag is positioned in the sensor slot so as to block light to the transistor. Front clamp 46 carries a flag 96 which will actuate sensor 94 when the front clamp is in the home position, as will be described later.

The carriage assembly 45 further includes a clamp sensor 98 which is actuated when the front and rear clamps have clamped a book. Clamp sensor 98 is mounted on frame 50 and is a slot type sensor actuated by a flag 100 carried on back clamp 44.

Referring back to FIG. 8, the base assembly 42 includes a tape feed mechanism for receiving the binding tape and various platens for forming the book seals. The base assembly includes a base frame 102 for mounting the various components which comprise the base assembly.

The base assembly 42 includes a cool platen 104 which is rigidly secured to base frame 102. Cool platen 104 supports the book during the initial and final stages of the binding sequence. A movable platen assembly, generally designated by the numeral 106, is positioned on frame 102 adjacent fixed cool platen 104.

Figure 5:
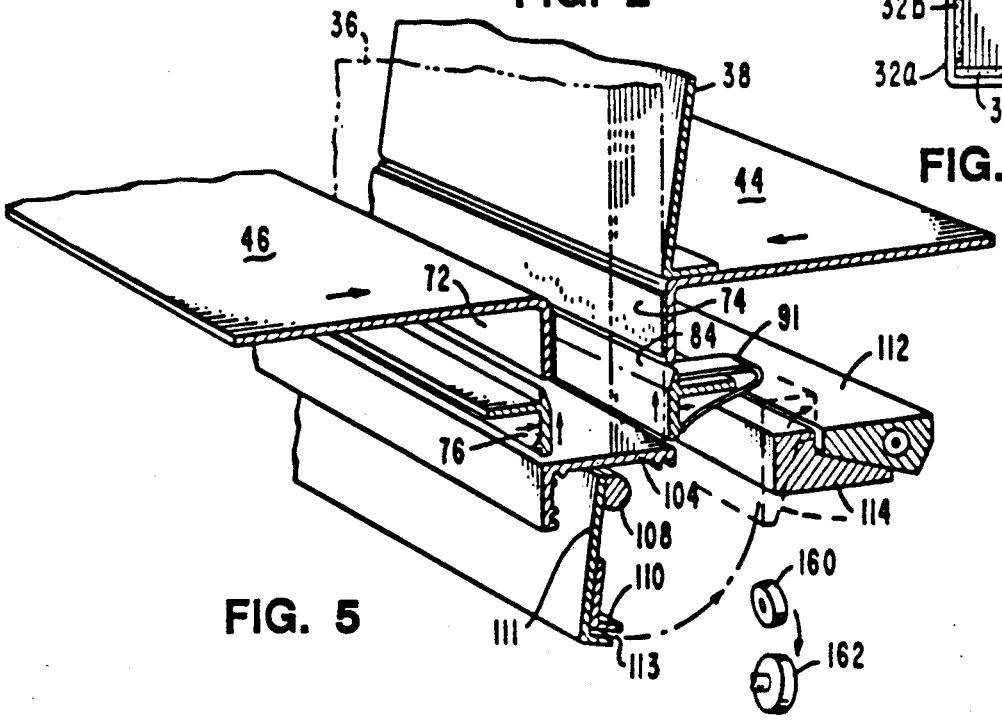
FIG. 5 is an elevated cross-sectional view of the subject binding apparatus showing key elements including the front clamp, rear clamp, tape positioner, cool platen and rotating platen.
Figure 7:
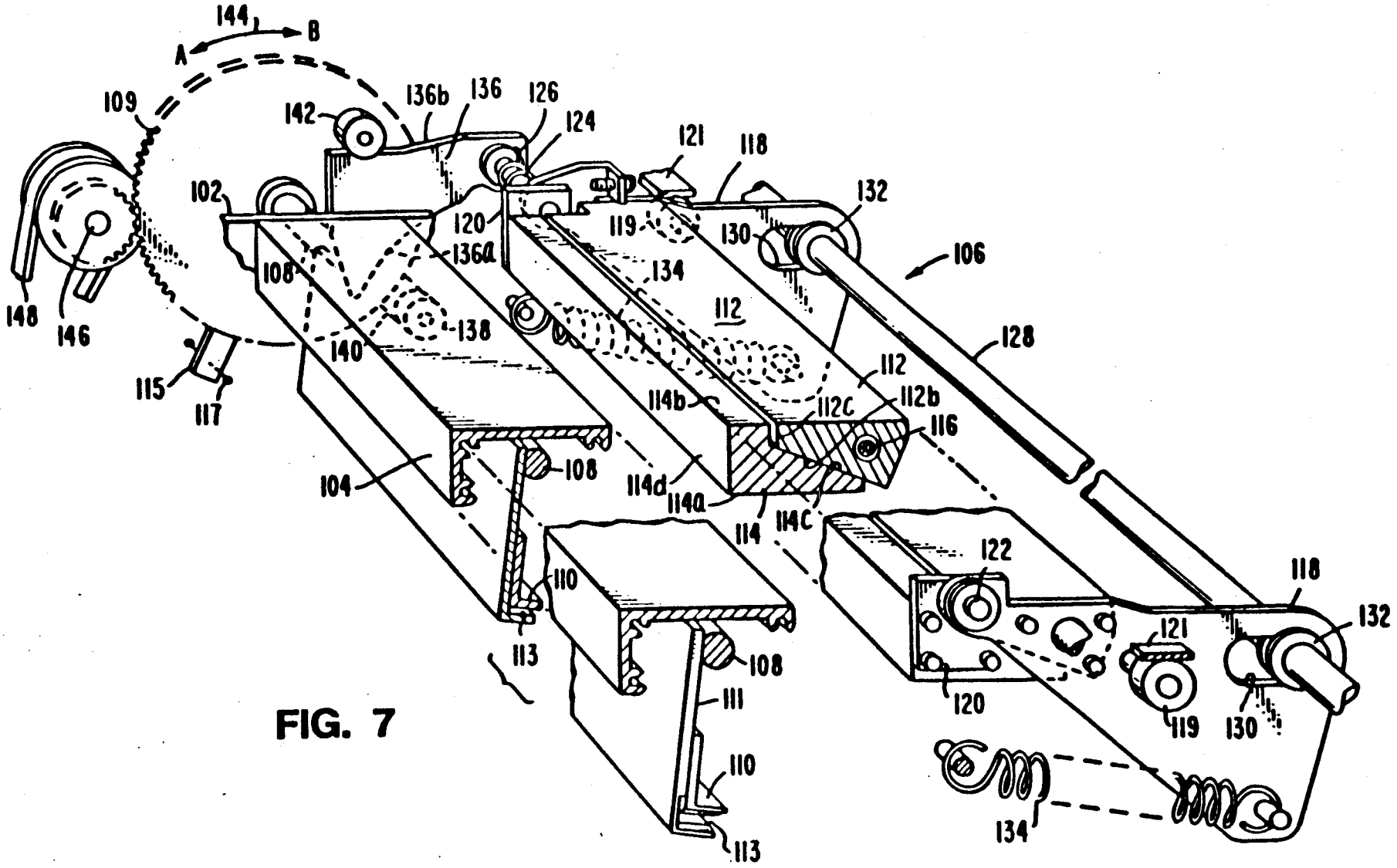
FIG. 7 is an elevated cross-sectional view of the subject binding strip showing key elements, including the tape positioner gear (in phantom), the cool platen, binding tape feed bar and the rotating platen.

Further details of cool platen 104 and moveable platen assembly 106 may be seen in FIGS. 5 and 7. Cool platen 104 includes a horizontal surface for receiving the book.

A tape positioner shaft 108 is located immediately below cool platen 104. The positioner shaft is rotatably mounted on frame 102 and is driven in either direction by a tape positioner gear 109 (FIG. 7). The positioner shaft 108 carries a tape feed bar 110 by way of a support arm 111 which supports the binding tape during the initial stage of the binding sequence. Tape feed bar 110 is provided with a slot or groove 113 which receives tape, as will be described.

Moveable platen assembly 106 includes a heated platen 112 and a rotating platen 114. In operation, heated platen is heated to approximately 420° F. by a conventional heating element 116 mounted inside the heated platen. Heated platen 112 is supported at either end by direct connection to end brackets 118. The heated platen includes a top surface **112*a*** which engages the binding tape during the binding sequence.

Rotating platen 114, preferably made of solid aluminum, is positioned adjacent heated platen 112 and is also supported by end brackets 118. A pair of pivot 114 plates 120 are secured to the ends of rotating platen for rotatably mounting the platen on brackets 118.

Rotating platen 114 has a first surface **114*a* which is used to form the first seal to the book cover. A second surface 114*b* is used to form the second seal to the remaining book cover. Rotating platen 114 is shown in FIG. 7 in a horizontal position where surface 114*c* of the platen is in intimate contact with surface 112*b* of the heated platen. Thus, when rotating platen 114** is in the horizontal position, heat is transferred from the heated platen to the rotating platen by conduction.

One of the pivot plates 120 which supports the rotating platen carries a pivot pin 122 and the other carries a pivot shaft 124. Pivot pin 122 and coaxial pivot shaft 124 are arranged such that rotating platen 114 rotates about an axis located at the junction of platen surfaces **112*a* and 114*b*. A spring 126 is disposed around pivot shaft 124 to bias the rotating platen to the horizontal position so that rotating platen 114 will normally be heated by the heated platen 112. Rotating platen 114** has sufficient heat retention properties to provide the desired heating when the two seals are formed, at which times the platen is rotated to the vertical position.

The movable platen assembly 106 is mounted on base frame 102 so that the assembly may be slightly translated in either the vertical or horizontal direction. A pivot shaft 128, mounted on the base frame, extended through elongated openings 130 in end brackets 118. Pivot bearings 132 secure the end brackets in place, limiting lateral movement of the assembly. A pair of platen springs 134 are provided, each having one end secured to the base frame and the remaining end secured to the end bracket 118 below shaft 128.

Moveable platen assembly 106 may be manually pivoted about shaft 128 from an operating position to an open position to facilitate servicing of the machine. As can be seen in FIG. 9A, a front view of the platen assembly, a pair of stop bearings 119 are rotatably mounted at opposite ends of the platen assembly. Platen springs 134 (FIG. 7) have a tendency to pivot the forward portion of the platen assembly upwards about pivot shaft 128. A pair of stop brackets 121, secured to base frame 102, normally engage stop bearings 119 thereby limiting upward movement so that the assembly will remain in the operating position.

In the event the platen assembly is to be placed in an open position for servicing and the like, a rearward force is manually applied to the assembly. If the platen assembly is heated, protective gloves or the like should be used. Rearward movement of the assembly causes the platen springs 134 to stretch slightly and the forward portion of elongated openings 130 to contact pivot bearings 132 (FIG. 7). At this point, stop bearings 119 are no longer disposed below stop brackets 121. As can be seen in FIG. 9B, the platen assembly 106 can then be manually lifted, using gloves if necessary, to the open position. This permits cleaning of the platen assembly, removal of jammed binding tape from the tape feed bar 110 and other servicing of the machine.

Rotating platen 114 is rotated by a lever arm 136 secured to pivot shaft 124 (FIG. 7). Lever arm 136 has a lower bearing surface **136*a* which engages an outer cam bearing 138 (shown in phantom). Outer cam bearing is secured to the tape positioner gear 109 by way of an arm support 140. Thus, cam bearing 138 rotates with the positioner gear 109 in an arc coaxial with the gear. The tape positioner shaft 108** is also driven by the gear.

Lever arm 136 further has an upper cam bearing surface **136*b* which engages an inner cam bearing 142 also mounted on positioner gear 109. Cam bearing 142 is positioned closer to the axis of rotation of gear 109 than outer cam bearing 138**, with the radius of curvature of the inner cam bearing arc being less than that of the outer cam bearing.

Positioner gear 109 may be driven in either direction, as represented by arrow 144. Gear 109 is driven by a smaller drive gear 146, which is, in turn, driven by a tape positioner motor (not depicted in FIG. 7). In the event positioner gear 109 is driven in direction A, indicated by arrow 144, outer cam bearing 138 will engage lower surface **136*a* of lever arm 136 causing the rotating platen 114** to pivot from a horizontal position to a vertical position.

In the event the positioner gear 109 is driven in direction B, indicated by arrow 144, inner cam bearing 142 will engage upper surface **136*b* of lever arm 136. This action will force the platen assembly 106 down, causing platen springs 134** to expand slightly.

Positioner gear 109 also carries a positioner flag 115 which operates in conjunction with a positioner home sensor 117. Sensor 117 is a slot type optical sensor mounted on the base frame 102. The sensor 117 is activated when flag 115 enters the sensor slot. As will be subsequently described, sensor 117 provides a reference point for controlling the position of tape positioner gear 109.

The base assembly 102 further includes a tape feed mechanism for properly positioning the binding tape. As can be seen in FIG. 8, the base frame 102 includes an opening 150 for receiving the tape. The end of the tape is manually inserted in the opening with the adhesive strips facing upwards. Once the presence of the tape is detected by the tape feed mechanism, the mechanism automatically draws the tape into the apparatus and positions the tape for binding.

Details of the construction of the tape feed mechanism are shown in FIGS. 10 and 13–15. The feed mechanism includes a tape guide assembly, generally designated by the numeral 152. A principal function of the tape guide assembly is to align the end of the binding tape 32 with the slot 113 in the tape feed bar 110. Tape feed bar 110 has a fluted section (not designated) at the end of the bar to guide the tape into slot 113. The assembly includes a tape guide pivot arm 154 which is pivotally mounted on shaft 156 which is secured to the base assembly frame.

One end of pivot arm 154 carries a tape guide 158 which is generally perpendicular with respect to the pivot arm. Tape guide 158 includes an inner pair of tabs 158*a* which define a slot therebetween generally coplanar with groove 113 of the tape feed bar 113. The guide further includes an outer pair of tabs 158*b*, which define a slot therebetween which is coplanar with the slot defined by inner tabs 158*a* and groove 113 and spaced apart from the inner tab. An idler roller 160 is rotatably mounted on guide 158, with the periphery of the roller being aligned slightly past the slots defined by tabs 158*a* and 158*b*. Coplanar groove 113 and the slots defined by tabs 158*a* and 158*b* define a tape feed path. When a binding tape 32 is inserted in the tape feed path, the tape will contact the idler roller 160.

Tape guide 158 also includes a blocking tab 158*c* which extends from outer tab 158*a* and which is generally parallel with respect to pivot arm 154. Blocking tab 158*c* functions to block the opening 40 in the housing (FIG. 1) to enable a binding tape to be inserted only when needed.

The tape feed mechanism further includes a feed roller 162 mounted on one end of a drive shaft 164. The drive shaft 164 is rotatably mounted on the base assembly frame by way of ball bearings (not shown). A pulley 166 is mounted on the other end of the drive shaft 164. Pulley 166 carries a drive belt 168 which is driven by a tape feed motor 210 (not shown in FIG. 10) mounted on the base frame.

Tape guide assembly 152 is pivoted about shaft 156, between a tape drive position and a disengage position, by a solenoid 170. The assembly is normally held in the no feed position by a guide assembly spring (not depicted). Solenoid 170 is mounted on the base assembly frame 102 by way of a mounting bracket 172. The solenoid actuator 174 is coupled to the free end of pivot arm 154 by way of a spring 176.

Figure 13:
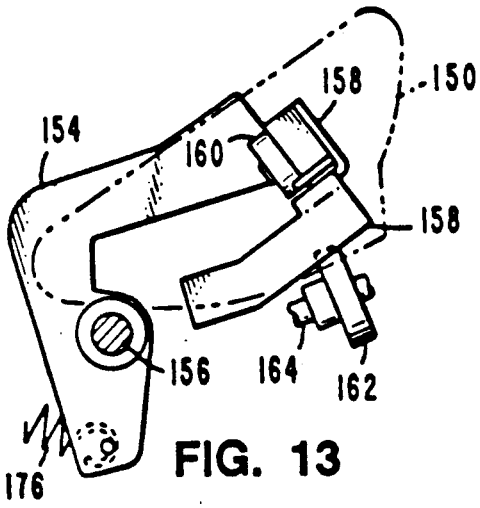
FIG. 13 shows the tape guide pivot arm of the FIG. 10 tape feed mechanism in a closed position so as to prevent manual feeding of an additional binding tape.

When the tape guide assembly is in the disengaged position, solenoid 170 is off. As can be seen in FIG. 13, the guide assembly spring (not depicted) retains the assembly in the disengaged position, with the idler roller 160 displaced from the feed roller 162. Blocking tab 158*c* is positioned to prevent a binding tape from being inserted in the tape feed mechanism.

Figure 14:
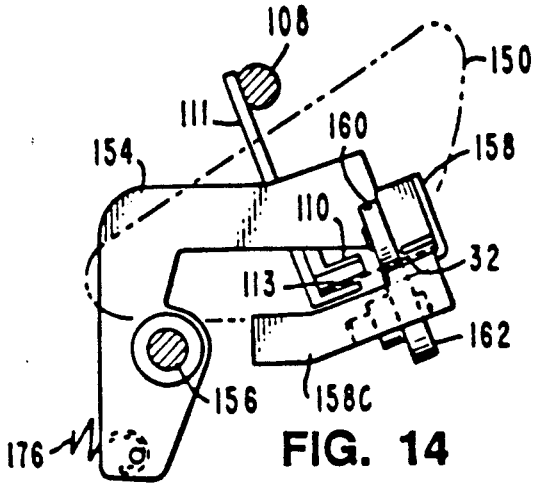
FIG. 14 shows the tape feed mechanism of FIG. 10 with a relatively narrow binding tape in the process of being fed into the subject apparatus.

During the initial stages of the binding sequence, solenoid 170 is turned on causing actuator 174 to retract thereby pulling the lower portion of pivot arm 154 towards the solenoid by way of spring 176. The force applied by solenoid 170 causes the tape guide assembly to pivot to the tape drive position, as depicted in FIG. 14. Blocking tab 158*c* is depressed below the opening 150 to permit a binding tape 32 to be manually inserted in the tape feed mechanism.

As will be subsequently described, the tape feed bar 110 will be rotated by tape positioner shaft 108 so that the feed bar will be positioned opposite the tape guide 158. The position of the feed bar 110 with respect to the tape guide is a function of the width of the binding tape to be used which, in turn, is a function of the thickness of the book 36 to be bound.

A thin book, typically less than ½ inch thick will be bound with a narrow binding tape having a width of approximately 1 3/16 inches. A medium width book having a thickness ranging from approximately ½ inch to 1 inch will be bound with a medium width tape of 1 11/16 inches. A relatively thick book having a thickness ranging from 1 inch to 1½ inches will be bound with a wide tape of approximately 2 3/16 inches.

The position of feed bar 110 in FIG. 14 corresponds to a book having a thickness which utilize a binding tape of medium width. Upon prompting by display 33 (FIG. 1), the user inserts a medium width binding tape 32, positioning the tape, with the adhesive strips up, on tape guide 158. As will be subsequently described, a sensor will detect the presence of the tape and will cause the tape feed motor to turn on thereby causing the feed roller 162 to rotate. Rotation of the feed roller 162 will cause the binding tape to be gripped between the feed roller and idle roller 160 thereby causing the binding tape to be drawn along grove 113 of tape feed bar 110. The feed roller will rotate until the tape is fully inserted in the feed bar.

Figure 15:
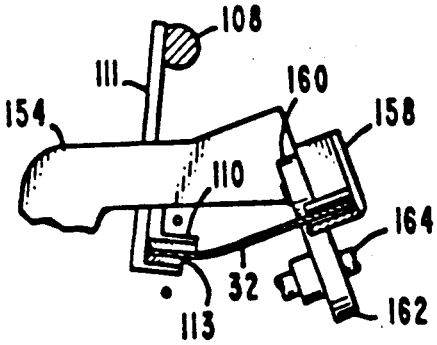
FIG. 15 shows the tape feed mechanism of FIG. 10 with a relatively wide binding tape in the process of being fed into the subject apparatus.

In the event the book 30 is relatively thick, the display 32 will indicate to the operator that a wide binding tape is to be inserted. As depicted in FIG. 15, tape feed bar 110 will be positioned relative tape guide 158 to accommodate the width of a wide tape. The feed bar will be positioned relatively close to tape guide 158 in the event the book to be bound is thin. In that event, the display will prompt the operator to insert a narrow binding tape.

Figure 22:
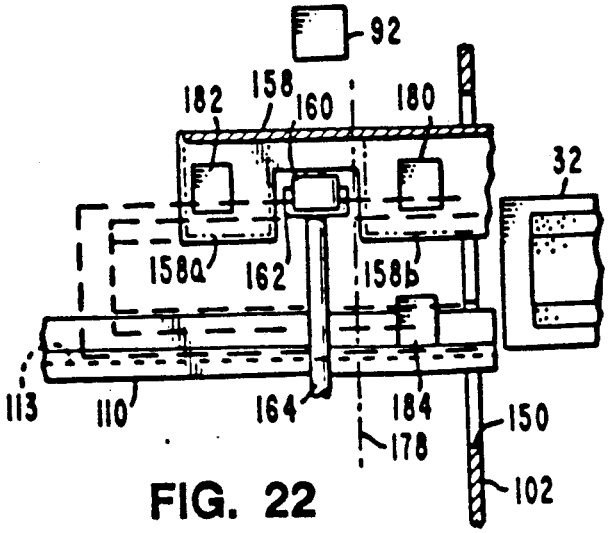
FIG. 22 is a schematic diagram of the tape feed mechanism showing the inner and outer tape position sensors and the tape width sensor.

FIG. 22 shows the three sensors associated with the tape feed mechanism together with the book position sensor 92. A binding tape is fully fed into the binding apparatus when the end of the tape coincides with the end-of-book line 178. Line 178 represents the position of the right end of the book when the book is properly positioned between the front and rear clamps 46 and 44. As previously noted, book sensor 92, mounted on the front clamp, will not be actuated unless the book is properly positioned between the clamps. The book must be in a right-justified position so that the end of the book will coincide with line 178.

An outer tape sensor 184 is positioned on tape feed bar 110 to detect the presence of a tape between opening 150 in housing 102 and feed roller 162. An inner tape sensor 182 is positioned on tape guide 158 to the left of the feed roller 162. Thus, sensor 182 will detect the presence of the tape when it has been fed past feed roller 162. Sensor 182 is a reflective type sensor and sensor 184 is preferably a slot type optical sensor which is more accurate than a reflective sensor.

Alternatively, the inner tape sensor 182 and tape width sensor 180 can be mounted on the base assembly frame immediately below the tape guide 158. Sensor 182 detects the presence of tape by way of an opening in the lower outer tab 158*b*. A corresponding opening is located in the upper tab 158*b* so that light will not be reflected unless tape is present. Sensor 182 detects the presence of tape at the periphery of inner tab 158*a*. The advantage of this alternative configuration is that sensors 180 and 182 remain fixed and do not move with the tape guide assembly.

The tape feed mechanism includes a third sensor, a tape width sensor 180 mounted on tape guide 158. The function of sensor 180, a reflective type sensor, is to verify that a tape 32 has been inserted of the proper width. It is not possible to insert a tape of greater width than prescribed since the tape feed bar 110 will be positioned too close to the tape guide 158 to permit the tape to be inserted. It is, however, possible to insert a tape which is narrower than prescribed. For example, if the apparatus has measured a book and determined that a wide tape should be used, it is possible for the user to incorrectly insert either a medium or narrow width tape. In that event, either sensor 180 or 184 will not detect the presence of the tape since the tape will not be sufficiently wide to simultaneously actuate both sensors. The display will issue an error message if an attempt is made to use a tape narrower than prescribed.

Figure 12:
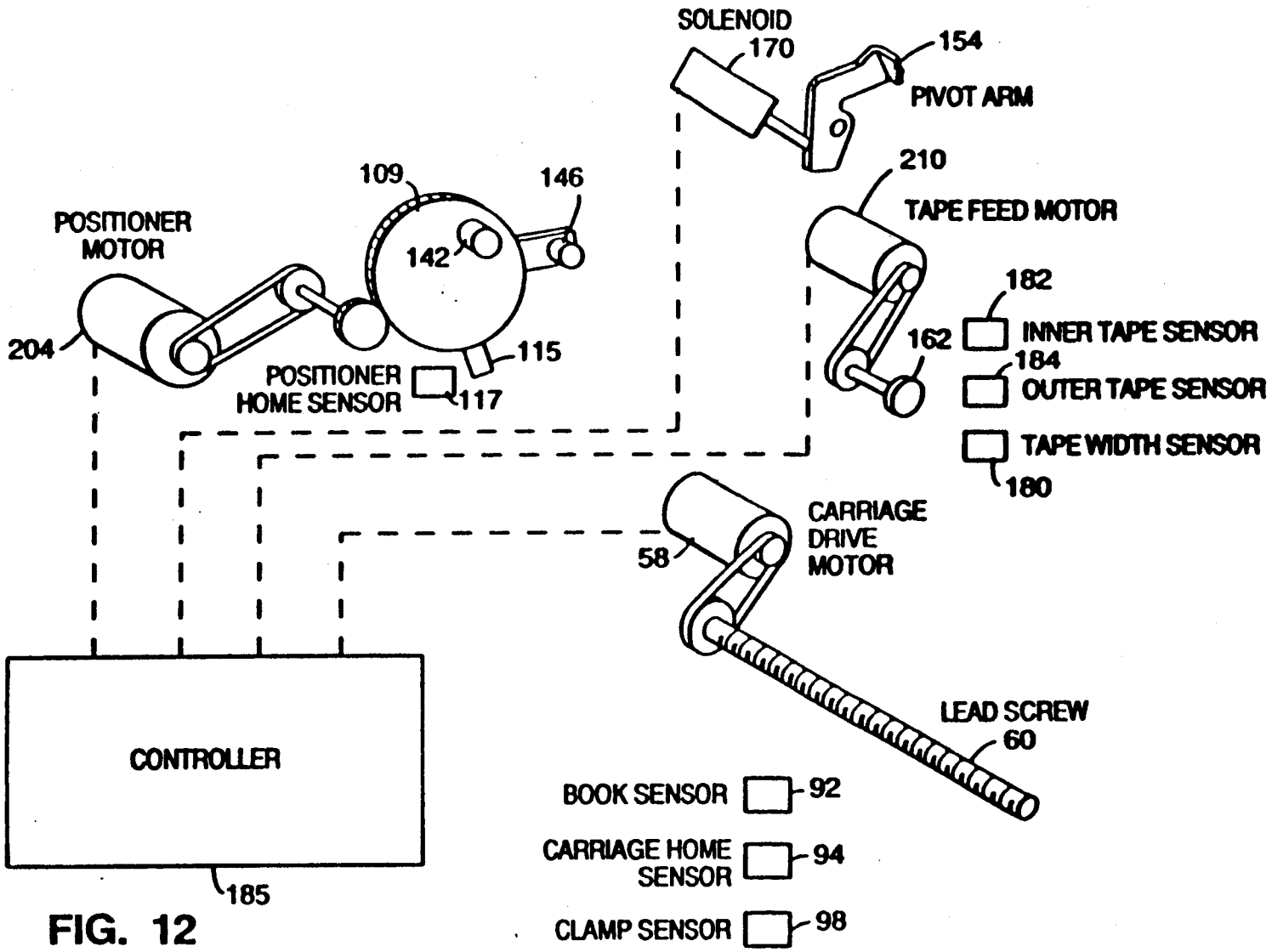
FIG. 12 is a simplified schematic representation of the various electro-mechanical drive elements of the subject binding apparatus.

FIG. 12 is a simplified schematic diagram of the principal drive components of the subject binding apparatus. The components for controlling the operation of the apparatus are collectively represented by element 185. Tape position motor 204 drives the tape positioner gear 109 and the carriage drive motor 58 drives lead screw 60. Tape feed motor 210 drives tape feed roller 162 and solenoid 170 actuates pivot arm 154 of the tape feed mechanism.

Figure 23:
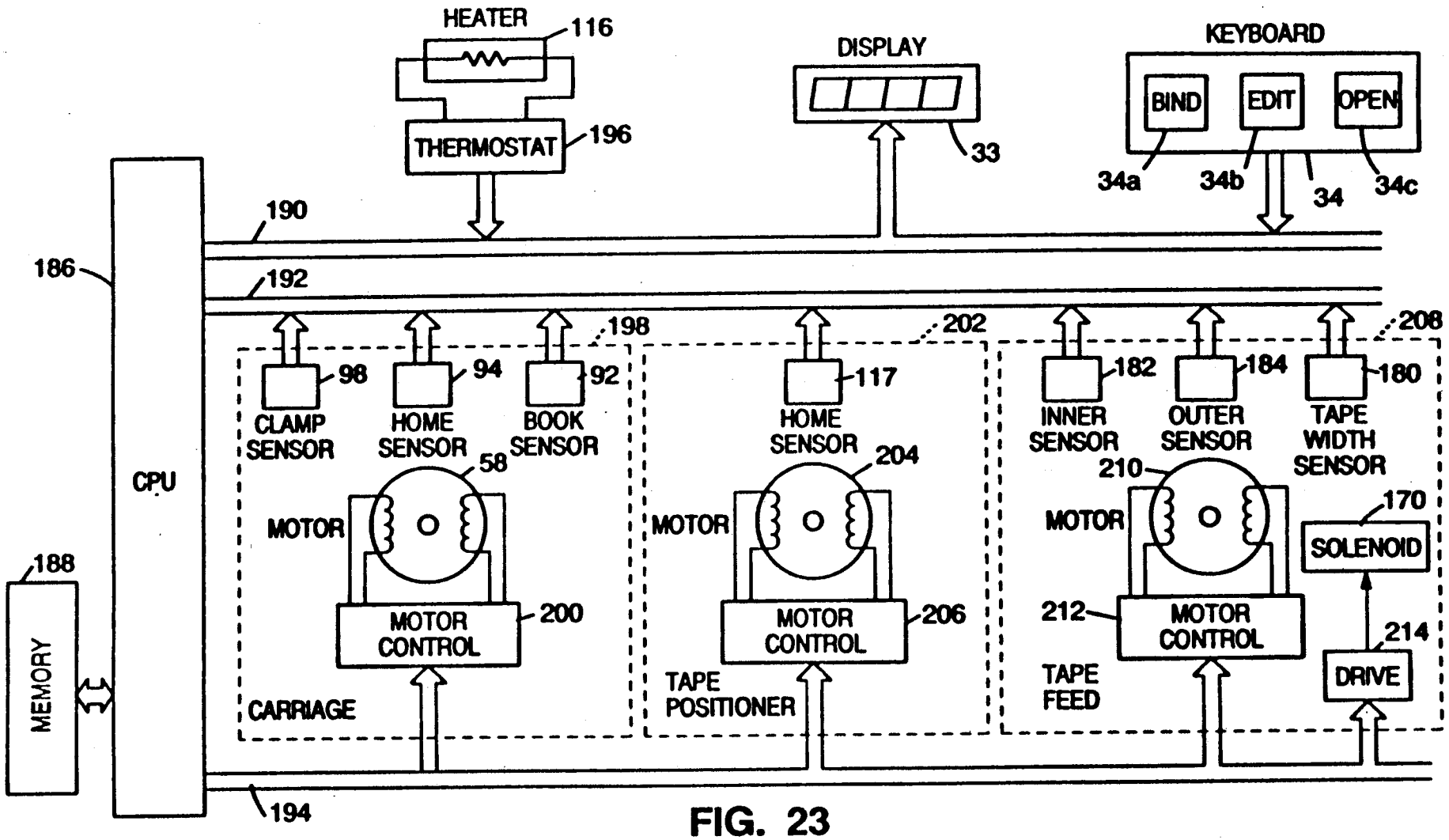
FIG. 23 is a simplified block diagram of the control circuitry of the subject binding apparatus, including the programmed, Central Processing Unit, the three drive motors and other primary components.

FIG. 23 is a simplified block diagram of the control circuitry of the subject binding apparatus. The circuitry includes a central processing unit or CPU 186. An 8 bit CPU sold by Intel under the designation 80C451 has been found suitable for this application. Various memory devices, represented by memory 188, are used in conjunction with CPU 186 for storing, among other things, the program for controlling the subject binding apparatus. Some of the memory devices which comprise memory 188 include an electrically programmable read only memory (EPROM) which will retain data in the absence of memory power.

CPU 186 has several internal input/output devices so that the CPU can be directly interfaced with the various sensors drivers and the like which comprise the subject binding apparatus. The various CPU input/output lines are represented by elements 190, 192 and 194.

At power up, CPU 186 will monitor the hot platen heating element 116 to verify that the platen has reached operating temperature. A thermostat 196 mounted on the hot platen is used for controlling the platen temperature. The heater is preferably isolated from the CPU by an optical coupler (not depicted).

CPU also controls the front panel display 32 and is responsive to inputs provided by the operator by way of control buttons 34. As will be subsequently described, button 34*a*, labeled "BIND" is used when a book is to be bound. Button 34*b*, labeled "EDIT", is used when it is desired to add sheets or delete sheets from a previously bound book. Finally, button 34*c* labeled "OPEN", is used to open front and rear clamps 46 and 48 to a maximum position.

Block 198 includes the various components, associated with carriage assembly 45. Carriage drive motor 58 is a conventional stepping motor which provides drive in both directions. Motor 58 is controlled by a bipolar motor control 200. Motor control 200 is preferably comprised of commercially available integrated circuit devices. A dual full-bridge driver circuit sold by SGS under the designation L998N can be directly coupled to the stepper motor and has been found suitable for the present application. The driver circuit is used in conjunction with a current controller also sold by SGS under the designation L6506. The driver circuit together with the current controller form a constant current drive for stepping motor 58 and interface directly with CPU 186, as represented by element 194.

The carriage assembly sensors include clamp sensor 98, home sensor 94 and, as previously noted, book sensor 92. The outputs of these sensors are coupled to CPU 186, as represented by element 194.

The tape positioner components are depicted in block 202. The tape positioner motor 204 is a conventional stepping motor which functions to drive positioner gear 109 in either direction in response to commands from CPU 186. Motor control 206 is a bipolar control for tape positioner motor 204 and is similar in construction to control 200. The tape positioner home sensor 117 output is coupled to CPU 186, as represented by element 192.

The components associated with the tape feed mechanism are depicted in block 208. Tape feed motor 210, which drives tape feed roller 162, is a conventional stepping motor. A motor control 212, similar in construction to controls 200 and 206, provides bipolar control for motor 210 in response to commands from CPU 186.

The outputs of inner tape sensor 182, outer tape sensor 184 and tape sensor 180 are coupled to CPU 186, as represented by element 192. Solenoid 170 which actuates tape guide pivot arm 154, is driven by a conventional discrete transistor circuit, represented by element 214. Solenoid 170 is actuated in response to commands from CPU 186, as represented by element 194.

Having described the construction of the subject binding apparatus, operation of the apparatus will now be described. As previously noted, the program for controlling the operation of the subject binding apparatus is stored in memory 188 (FIG. 23). The detailed source code for such a program would vary depending upon, for example, the exact physical dimensions of the binding apparatus, including gear ratios, pulley ratios and the like. It is believed that a description of the operation of the subject binding apparatus utilizing flow charts, timing diagrams and drawings is preferable to disclosure of a particular source code for the purpose of enabling one of ordinary skill to practice the subject invention.

Figure 24:
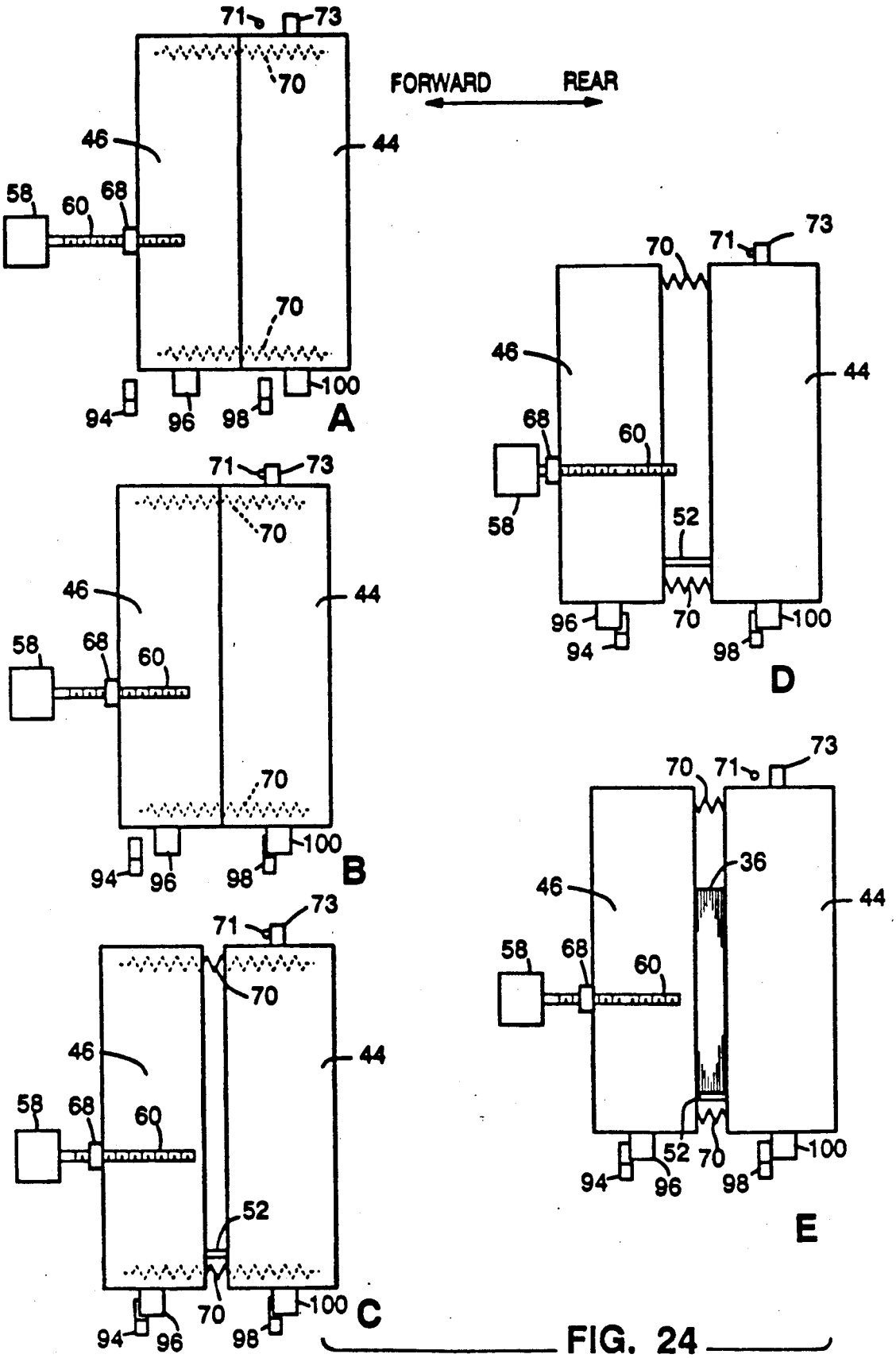
FIGS. 24A-24E show the various positions of the front and rear clamps of the carriage assembly during the initial stages of a typical binding sequence.

FIGS. 24A–24E depict the preliminary sequence for binding a book. FIG. 24A is a schematic representation of the front and rear clamps 46 and 44 of the carriage assembly. The clamps are shown clamped together in an uncalibrated position, with carriage drive motor 58 positioning the clamps towards the rear of the apparatus. In this position, neither the carriage home sensor 94 nor the carriage clamped sensor 98 are actuated.

Motor 58 is first caused to drive lead screw 60 in a forward direction, as shown in FIG. 24B, which pulls the front clamp 46 forward. Rear clamp 44 is pulled with the front clamp by carriage springs 70. Rear clamp 44 will continue to follow the front clamp until stop member 73 on the rear clamp contacts boss 71. At this time, flag 100 will actuate clamp sensor 98.

Motor 58 will continue to drive the front clamp 46 in a forward direction as shown in FIG. 24C. The rear clamp 44 will not move forward because member 73 is contacting boss 71. Front clamp 46 will continue to move forward expanding springs 70 until the carriage home sensor 94 is actuated by flag 96 carried on the front clamp. Front and rear clamps 46 and 44 are now in the carriage home position.

Motor 58 will continue to drive front clamp 46 a predetermined number of steps from the carriage home position until the front and rear clamp are separated a maximum amount as shown in FIG. 24D. The carriage assembly is then in the open wide position and ready to accept a book of maximum thickness. Flag 96 is of sufficient width that the carriage home sensor 94 will remain actuated when the front clamp travels from the carriage home position of FIG. 24C to the open wide position.

When the carriage is in the open wide position, a book 36 to be bound or edited is positioned between the two clamps, resting on cool platen 104 (FIG. 5). The book is right justified so that book sensor 92 (FIG. 23) will be actuated.

The drive motor 58 will then reverse direction thereby causing the front clamp 46 to be driven rearward towards the book 36. When the front clamp contacts the book 36, the rear clamp 44 will be forced rearward. As shown in FIG. 24E, flag 100 on the rear clamp will clear clamp sensor 98 thereby indicating that the book is clamped. The number of steps required by motor 58 to advance the front clamp from the open wide position to the clamped position is indicative of the thickness of the book to be bound. This information is stored and used to determine whether a narrow, medium or wide tape is to be inserted. In addition, the information is used for controlling the tape positioner, as will be described.

Figure 25A:
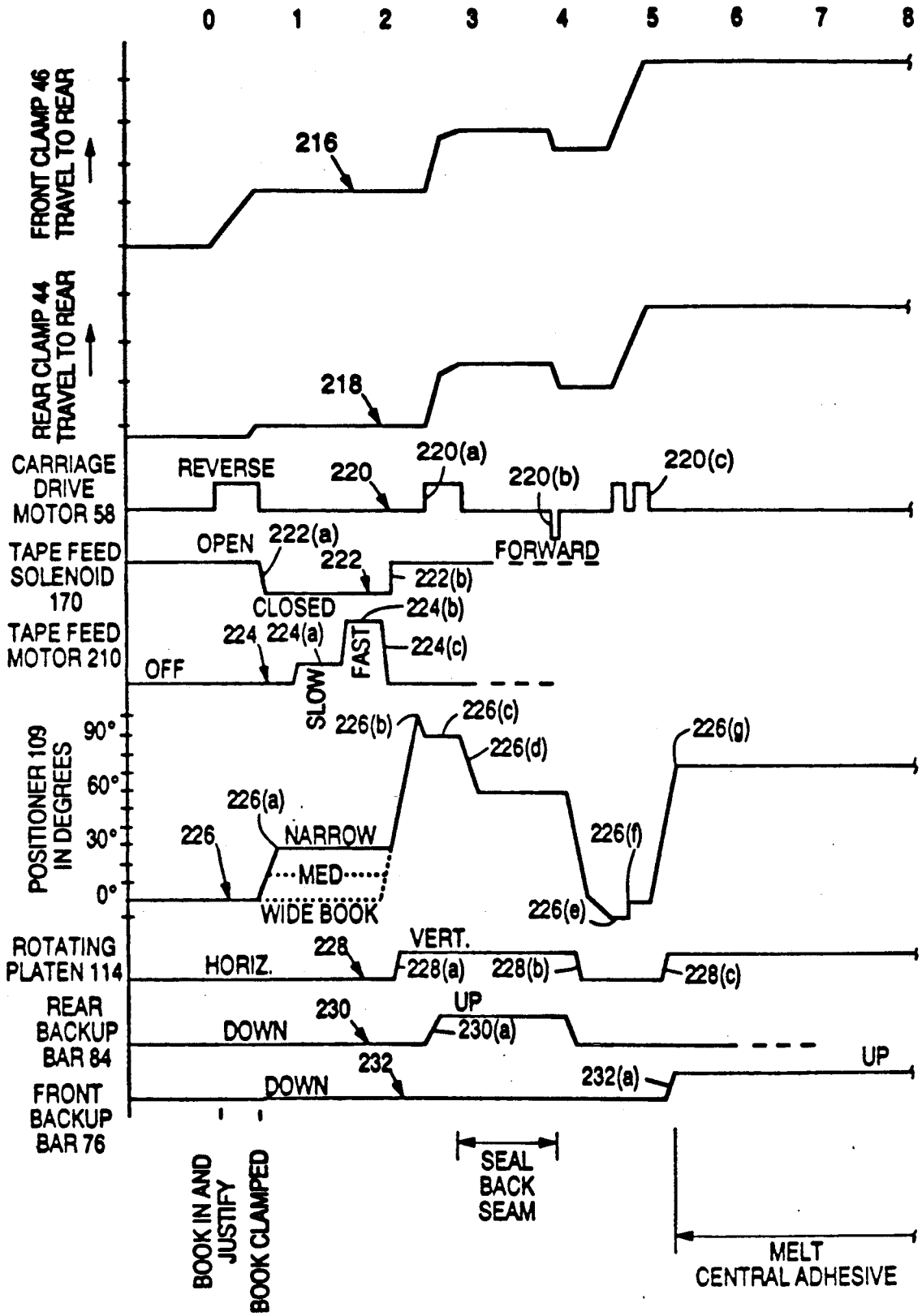
FIGS. 25A and 25B are a timing diagram which show the position of the various binding apparatus mechanical components during a typical binding sequence.
Figure 25B:
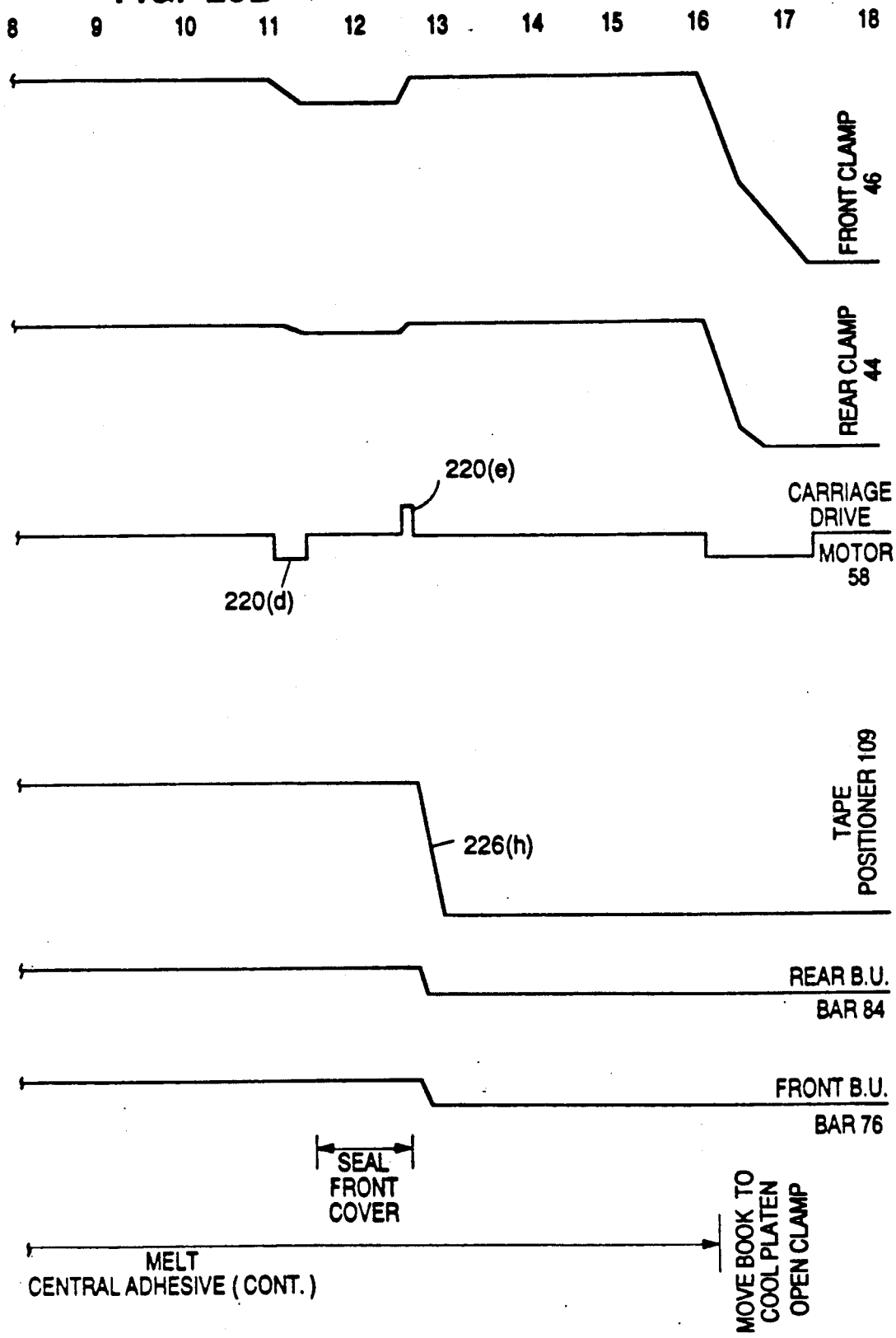

The remaining description of the operation the subject binding apparatus will be made with reference to the flow chart, timing diagrams and other figures of the drawings, FIGS. 25A and 25B are a timing diagram depicting the position of the various mechanical components throughout an exemplary binding sequence for a book approximately one half inch thick. The sequence takes something less than approximately 20 seconds.

The top waveform 216 (FIG. 25A) represents the position of front clamp 46 throughout the binding sequence. The second from top waveform 218 represents the position of rear clamp 44 during the bind sequence. The next waveform down, waveform 220, represents the state of carriage drive motor 58. The condition of tape feed solenoid 170 is indicated by waveform 222 and the state of tape feed motor 210 is represented by waveform 224.

The position of tape positioner gear 109 is represented by the angle of rotation of the gear from the home position, as determined by sensor 117. This angle is represented by waveform 226. The state of rotating platen 114, either horizontal or vertical, is represented by waveform 228. Finally, the positions of rear cam shoe 91 and front cam shoe 82 are represented by waveforms 230 and 232, respectively.

The timing diagram of FIGS. 25A and 25B will be periodically referred to in the following description of the operation of the subject binding apparatus. A flow chart of the primary program stored in memory 188, is depicted in FIGS. 26A-26D. The beginning of the binding sequence is represented by element 234 of FIG. 26A. An initialization subroutine is first entered, as shown by block 236.

Figure 27A:
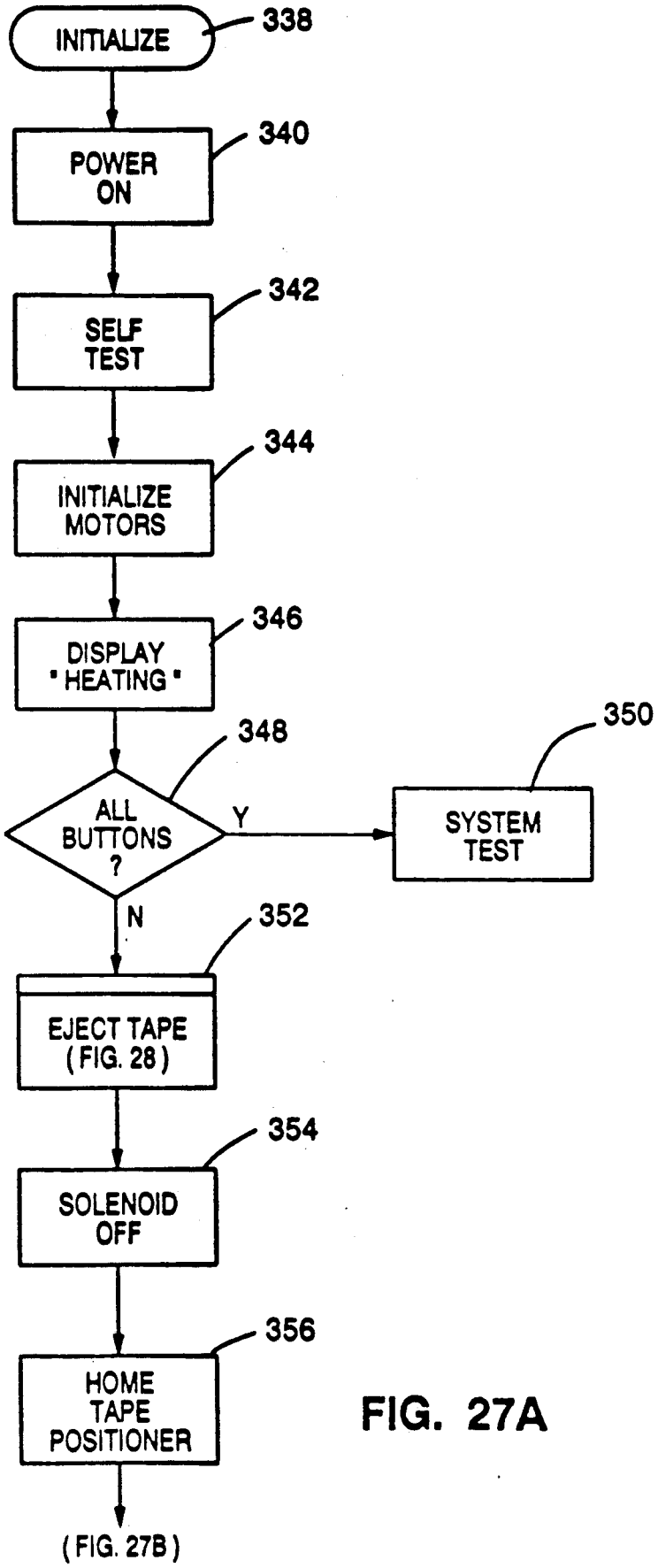
FIGS. 27A-27B is a simplified flow chart of the Initialize subroutine used in the primary software program of FIGS. 26A-26D.
Figure 27B:
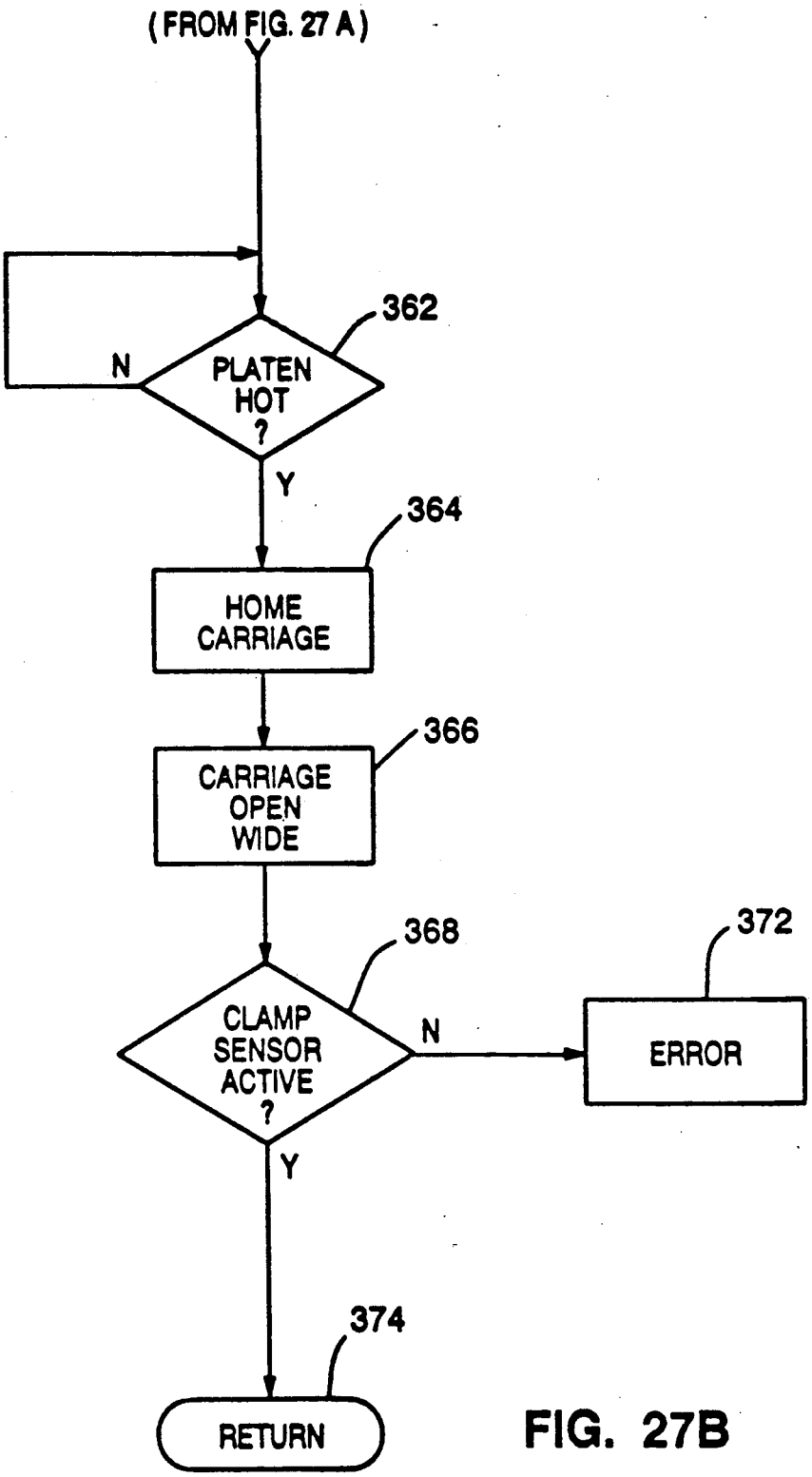

The initialization subroutine is depicted in the flow diagram of FIGS. 27A and 27B. Block 340 represents power on. As indicated by block 342, a self-test sequence is carried out to confirm operation of the binding apparatus electronics. Next, the various stepping motors are initialized or placed in a proper state. Since the heated platen 112 will not yet have reached operating temperature, the message "HEATING" will be shown on front panel display 33 as indicated by block 346.

The state of the three control buttons 34*a*, 34*b* and 34*c* are then examined, as represented by element 348. If all three buttons are simultaneously depressed, the system enters a diagnostic mode, as indicated by block 350. The diagnostic mode forms no part of the subject invention and will not be described.

Assuming that a self test is not requested, the program enters an eject tape subroutine as shown by element 352. This subroutine, which will be described later, is precautionary and functions to remove any binding tape which may be present in tape feed bar 110 from a previous binding sequence.

Solenoid 170 is then turned off thereby causing the tape guide assembly 152 to pivot away from feed roller 162, as shown by block 354 into the disengaged position. This enables blocking tab 158C (FIG. 13) to prevent premature tape feeding. Next tape positioner gear 109 is set to the home position utilizing sensor 117, as shown by block 356. In this position, tape feed bar 110 is displaced from the heated platen (FIG. 5) so that the feed bar will remain cool and not tend to melt the tape adhesive during tape feeding.

Referring to FIG. 27B, a determination is made as to whether the heated platen 112 has reached operating temperature. As shown by element 362, the sequence will enter an idle mode until the platen is at temperature. Next, as shown by block 364, the carriage assembly is placed in the home position as depicted in FIG. 24C. The carriage assembly is then driven to the open wide position as shown in FIG. 24D, according to block 366. A determination is then made, as indicated by element 368, as to whether clamp sensor 98 is in the active state, with flag 100 disposed in the sensor slot. Since the rear clamp should be abutting boss 71 in the open wide state, the sensor should be active and an error message will issue in the event it is not active, as indicated by block 372. The initialize subroutine is then completed, and the sequence will return to the main program at element 238 in FIG. 26A.

The display will then show a "READY" message as indicated by block 240. The states of "EDIT" button 34*b*, "BIND" button 34*a* and "OPEN" button 34*c* will then be periodically examined to determine whether an operator has depressed any of the buttons, as indicated by elements 242, 244 and 246, respectively.

Assuming that the operator wishes to bind a book, the operator would first position the book 36 to be bound between the front and rear clamps, making sure that the book is in a right-justified position. This stage is the binding sequence is represented by time=0 seconds in the FIG. 25A timing diagrams.

Figure 11:
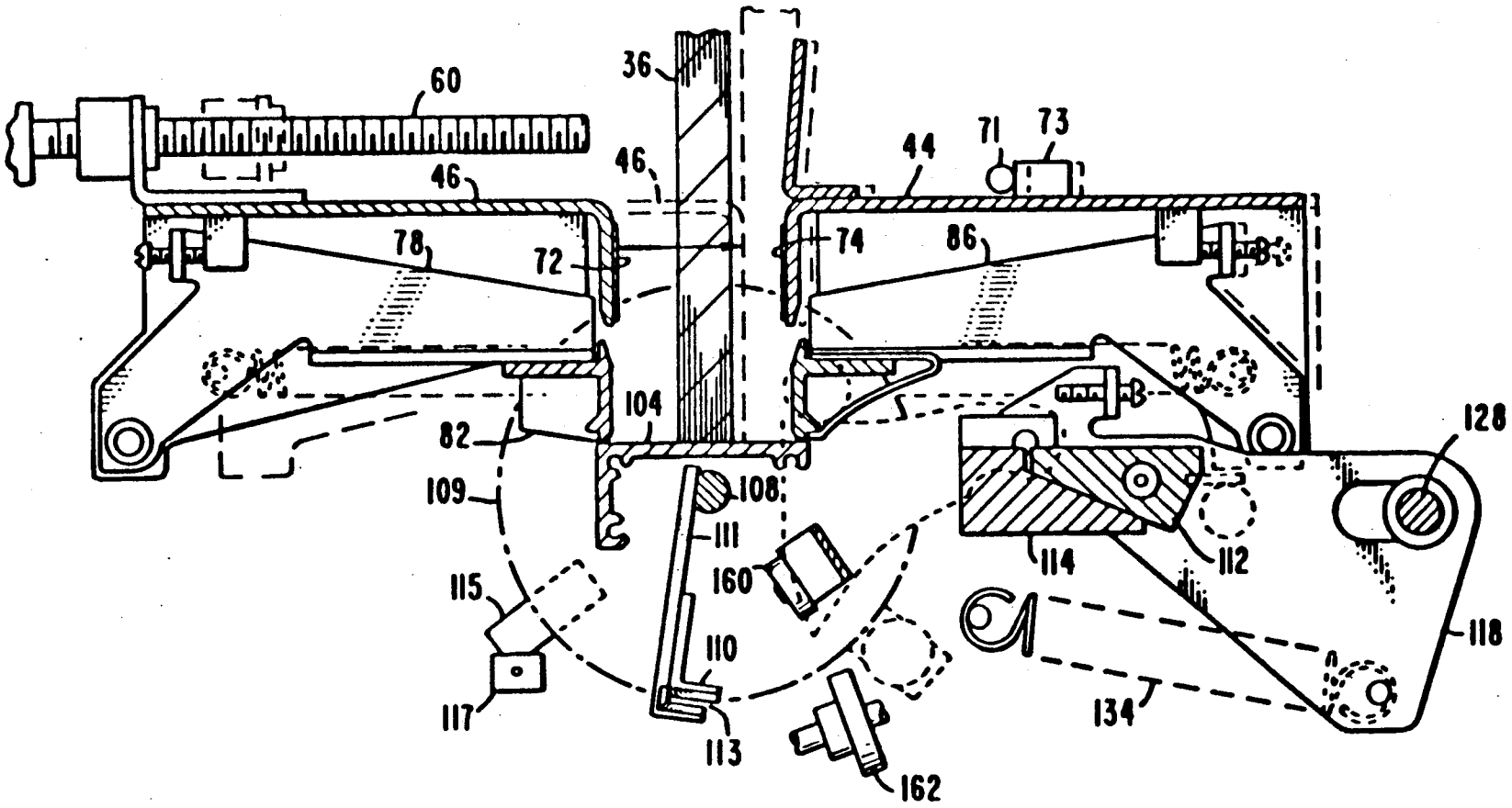
FIG. 11 is an elevational cross-sectional view showing the front and rear clamps gripping a book during the preliminary stage of the binding sequence.

As can be seen in FIG. 11, the book 36 initially rests on cool platen 104. The operator then actuates the "BIND" button 34*a*, which will be detected as indicated by element 244 of the FIG. 26A flow chart. The book is then clamped as represented by block 250 of the flow chart.

Clamping is accomplished by causing the carriage driven motor 58 to be driven in the reverse direction as represented by waveform 220 of FIG. 25A timing diagram. For a book with a thickness of approximately one half inch, waveform 216 of the timing diagram indicates that the front clamp will be driven from the open position in a rearward direction for approximately one and one half inches until the front clamp engages the book. As indicated by waveform 218, the rear clamp will move away slightly from the home position thereby causing the clamp sensor 98 to change state, as depicted in FIG. 24E and as shown in phantom in FIG. 11. Drive motor 58 will then be turned off as indicated by waveform 220.

As previously noted, the distance required by the front clamp to travel from the reference position (in this case from the open wide position) to the clamped position is indicative of the thickness of the book 36. A value representing the book thickness is computed and stored, as represented by block 252 of the FIG. 26A flow chart.

It should be noted that the reference position is determined by the thickness of the book last bound. For example, if the previous book called for a narrow tape, the reference position for the net bind would be the open narrow position. Similarly, if the previous book called for a medium tape, the reference position would be the open medium position.

As represented by element 254, the book sensor 92 is then examined to determine whether a book has been inserted, and, if so, inserted properly. Assuming that the book sensor does not sense a book, block 268 indicates that the carriage assembly will be opened. A "JUSTIFY" message will then be displayed for about 2 or 3 seconds as shown by blocks 270 and 272. The sequence will then cause a "READY" message to be displayed, as indicated by elements 238 and 240.

Figure 26A:
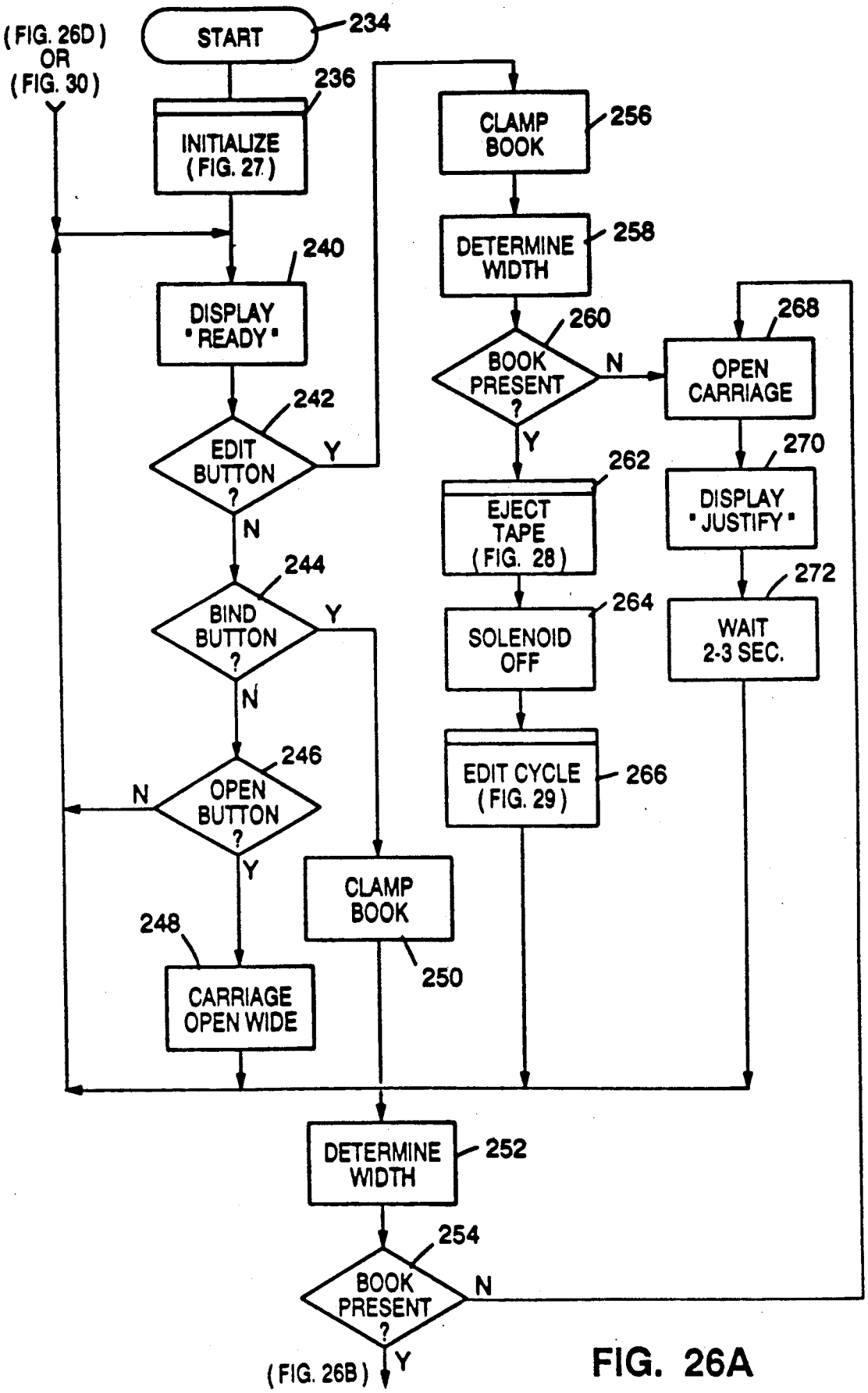
FIGS. 26A-26D is a simplified flow chart of the primary software program for controlling the Central Processing Unit.
Figure 26B:
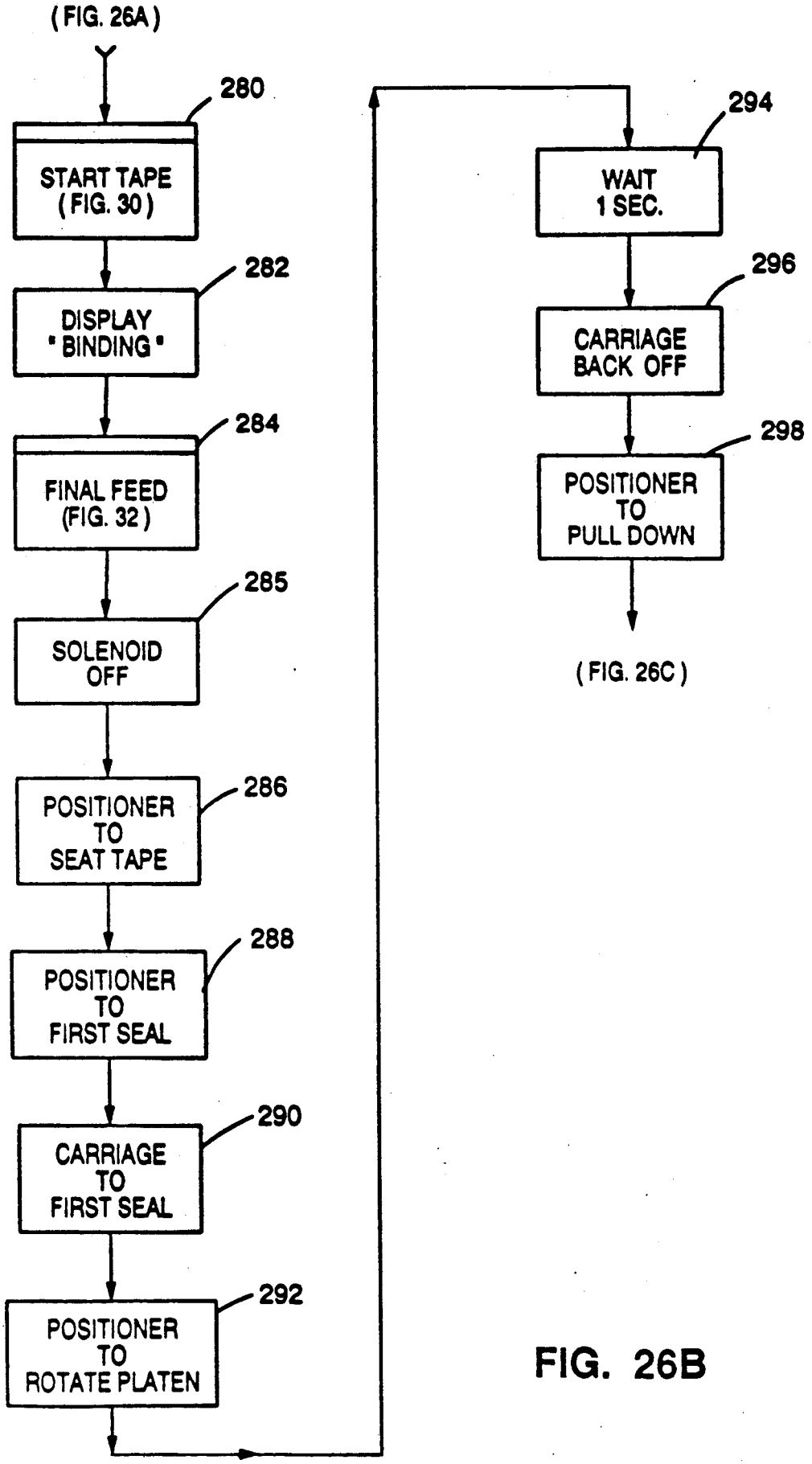

Assuming that the book was properly positioned (element 254), element 280 of the FIG. 26B flow chart indicates that a start tape subroutine is entered into. The subroutine accomplishes loading of the binding tape 32.

Figure 30:
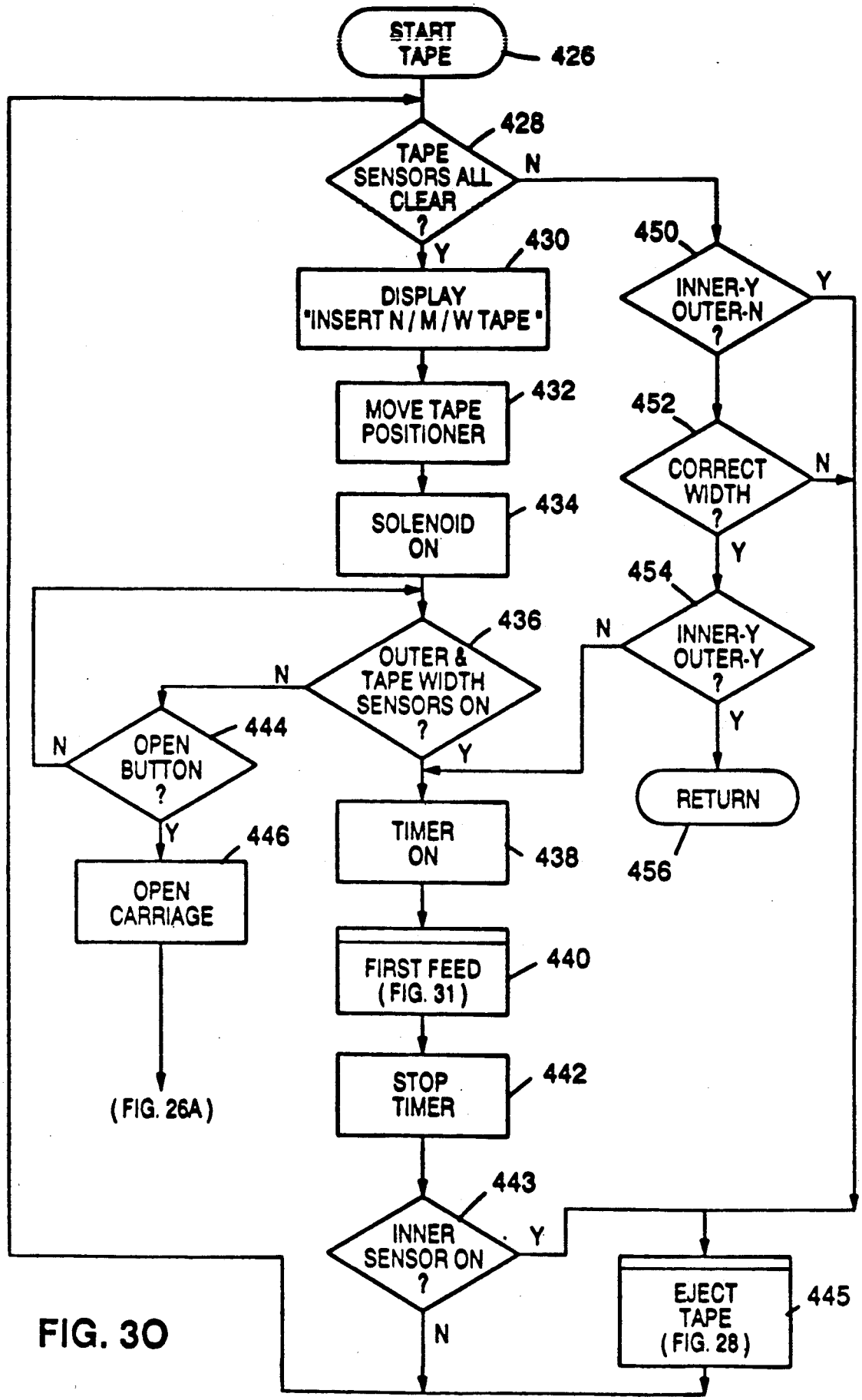
FIG. 30 is a simplified flow chart of the Start Tape subroutine used in the primary software program of FIGS. 26A-26D.

The start tape subroutine is illustrated in FIG. 30 flow chart. First, a determination is made as to whether there is presently a tape in the tape feed bar 111 by examining the inner and outer tape sensors 182, 184 and the tape width sensor 180. It is possible that a tape was inserted during a previous binding sequence, as will be described later.

If any of the three sensors detect the presence of a tape, a determination is made as to whether the tape was properly started. In the event the inner sensor 182 detects the presence of tape and the outer sensor 184 does not, an anomaly has occurred. As represented by element 450, a determination is made if such an anomaly has occurred, and if so, attempt is made to eject the tape by entering an eject tape routine represented by block 445, which will subsequently be described.

Assuming that the anomaly did not occur, a determination is made (element 452), whether the loaded tape is the correct width for the book to be bound. This is done by comparing the tape width just determined with a tape width value which was stored during the previous binding sequence. In the event the tape width is not correct, the eject tape subroutine will be executed.

Assuming that the tape width is correct, a determination is made as to whether the inner and outer tape sensors both detect the presence of the tape, as indicated by element 454. If both sensors do detect the tape, the tape is presently properly loaded. Accordingly, tape feeding is not required and the sequence returns to the main program as shown by element 456. If both sensors do not sense the presence of tape (element 454), an attempt will be made to load the tape properly and, if that is not possible, to eject the tape, as will be described.

Assuming that none of the three sensors detect the presence of tape, the display will show an "INSERT (X) TAPE" message with X being either "N" (narrow), "M" (medium) or "W" (wide) depending on the measured width of the book. In the present case, the one half inch thick book would dictate a narrow tape.

Once the message is displayed, tape positioner gear 109 will rotate to a position which corresponds to the width of the tape to be fed. The tape feed bar 111 will be positioned next to and spaced apart from tape guide 158 a distance which corresponds to the width of the tape to be fed into the machine as depicted in FIG. 14 for a narrow tape and FIG. 15 for a wide tape.

The timing diagram of FIG. 25A shows the rotation of positioner gear 109 in waveform 226 at point 226(*a*) to the narrow tape position. The tape positioner gear 109 drives the tape feed bar 110 by way of shaft 108, as previously described. Note that the narrow tape requires a rotation from the home position of approximately 20 degrees, whereas the wide tape requires no rotation.

At the same time that the tape positioner gear is rotated (if required), the tape feed solenoid 170 is actuated as represented by block 434. Actuation of solenoid 170 causes the pivot arm 154 to pivot down to the tape drive position, as shown in FIG. 14. Thus, the idler roller 160 will engage feed roller 162. Curve 222 of the FIG. 25A timing diagram, at point 222(*a*) illustrates actuation of the solenoid.

The operator then proceeds to insert a binding tape 32 into the tape feed mechanism, with the adhesive strips up. At this time, the tape feed motor 210 is not running. A determination is then made, as represented by element 436 (FIG. 30), whether outer tape sensor 184 (FIG. 22) and tape width sensor 180 detect the inserted tape. Assuming that a tape of the correct width is properly inserted, sensors 180 and 184 will both detect the tape and the tape feed sequence will proceed. However, if a tape is not sensed, it is possible that either no tape has been inserted, or a tape of incorrect width has been inserted.

If tape is not detected, it is possible that the operator elected to terminate the binding sequence by depressing the "OPEN" button 34C. If the button was not depressed, the sensors are again examined, as shown by elements 444 and 436. If the user did actuate the "OPEN" button, the carriage assembly will open to accept the book, as indicated by block 446. The sequence will then return to the main program ( FIG. 26A) Where the control button will be monitored for further input from the user.

If a tape of the correct width has been inserted, a timer is turned on which will limit the maximum time that the tape feed motor 210 will be permitted to run, as represented by block 438. The program will then proceed to execute a first feed subroutine, as indicated by blocks 440.

Figure 31:
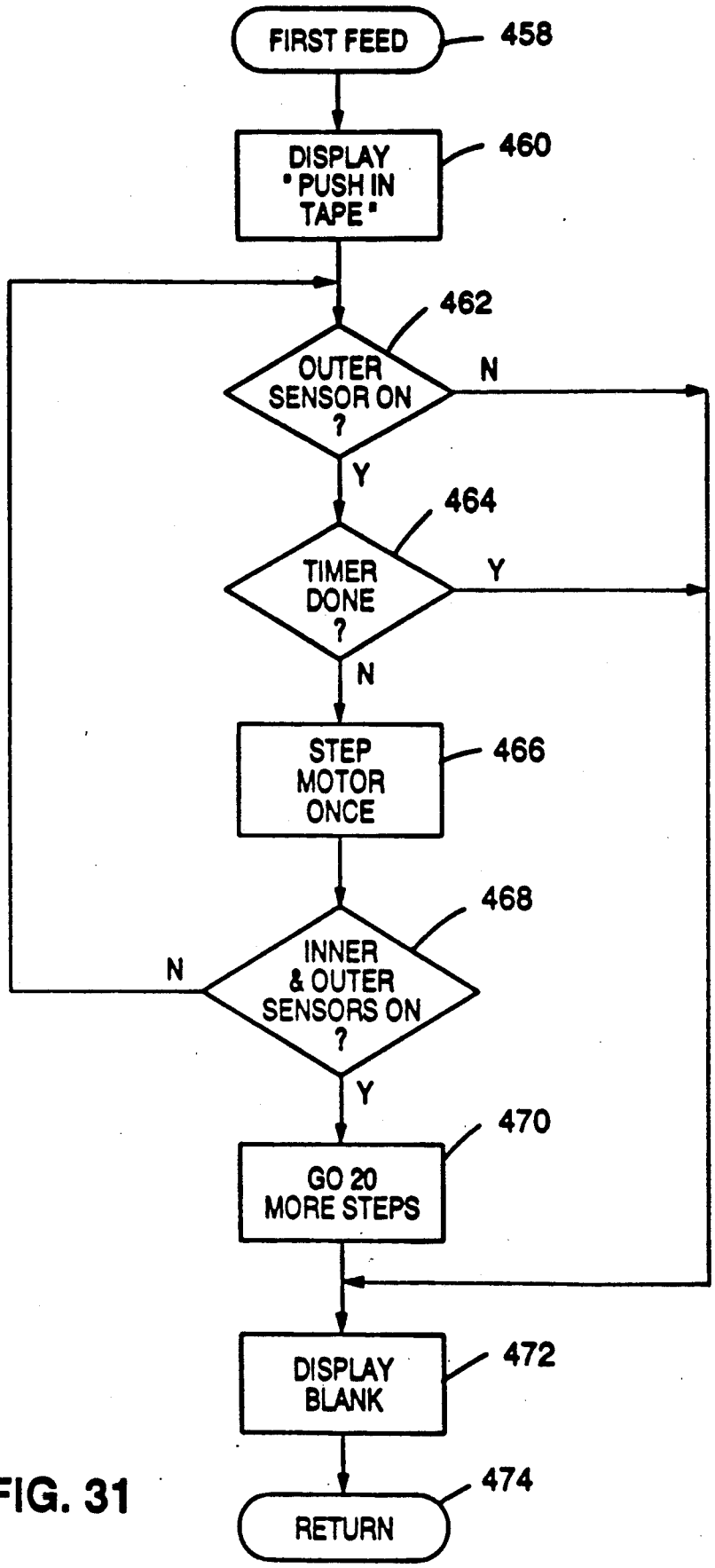
FIG. 31 is a simplified flow chart of the First Feed subroutine used in the Start Tape subroutine of FIG. 30.

The first feed subroutine flow chart is depicted in FIG. 31. As indicated by elements 458 and 460, a "PUSH IN TAPE" message is displayed to prompt the operator to push the tape into the machine so that it will be gripped between idler roller 160 and feed roller 162.

A determination is then made as to whether outer tape sensor 184 continues to sense the presence of the tape. If tape is no longer detected, the operator has withdrawn the tape. As represented by elements 462, 472 and 474, if the tape is not longer sensed, the display will be blanked and the sequence will return to the main program.

Assuming that the tape is still present, the timer associated with the tape feed motor is examined to determine whether it has timed out. If the timer has timed out, thereby indicating that a user has only partially inserted a tape for more than a predetermined amount of time, the sequence defaults to the main program, as indicated by elements 464, 472 and 474.

If the tape has been inserted properly, tape feed motor 210 will advance a single step, as indicated by block 466. The motor is driven in this manner so as to slowly grip the tape and withdraw the tape from the operator's hand. This step in the binding sequence is depicted by the tape motor feed waveform 224 in the FIG. 25A timing diagram at point 224(*a*).

Each time the tape feed motor 210 has completed a step, the inner tape sensor 182 and outer tape sensor 184 are examined to determined whether the tape has been fed into the machine a sufficient distance so as to be detected by the inner tape sensor 182. As indicated by element 468, the tape feed motor will continue to single step until both sensors 182 and 184 detect tape.

Once both sensors 182 and 184 detect tape, the tape feed motor will advance twenty steps, as indicated by block 470, thereby insuring that the tape has been inserted sufficiently to actuate inner tape sensor 182. The sequence then returns to the start tape subroutine of FIG. 30.

Returning to FIG. 30, block 442 indicates that the timer which limits the amount of time the tape feed motor will run (block 438) is stopped. A determination is then made as to whether the inner tape sensor 182 has detected the presence of tape as represented by element 443. If the first feed subroutine was successful, all three tape sensors will detect the presence of tape.

Unless an anomaly has occurred, the inner sensor will be actuated. If it is not actuated, the eject tape subroutine will be entered, as shown by block 445.

Assuming that no anomaly has occurred, the sequence will return to element 428. The sensors will not all be clear of tape, therefore the sequence will proceed to element 450. At this point the inner sensor 182 will be detecting tape, as will the outer sensor 184. Accordingly, a determination is then made as to whether a tape of the correct width has been loaded, as shown by element 452. If the width is proper, both outer sensor 184 and tape width sensor 180 will detect the tape.

A determination will then be made as to the whether the inner and outer tape sensors detect tape, as indicated by element 454. If both detect tape, the tape is in the proper position for this stage of tape loading and the start tape subroutine is completed. The sequence will then return to the main program, as represented by element 450. If both sensors do not detect tape, an anomaly has occurred and the first feed routine (block 440) will be repeated.

Figure 32:
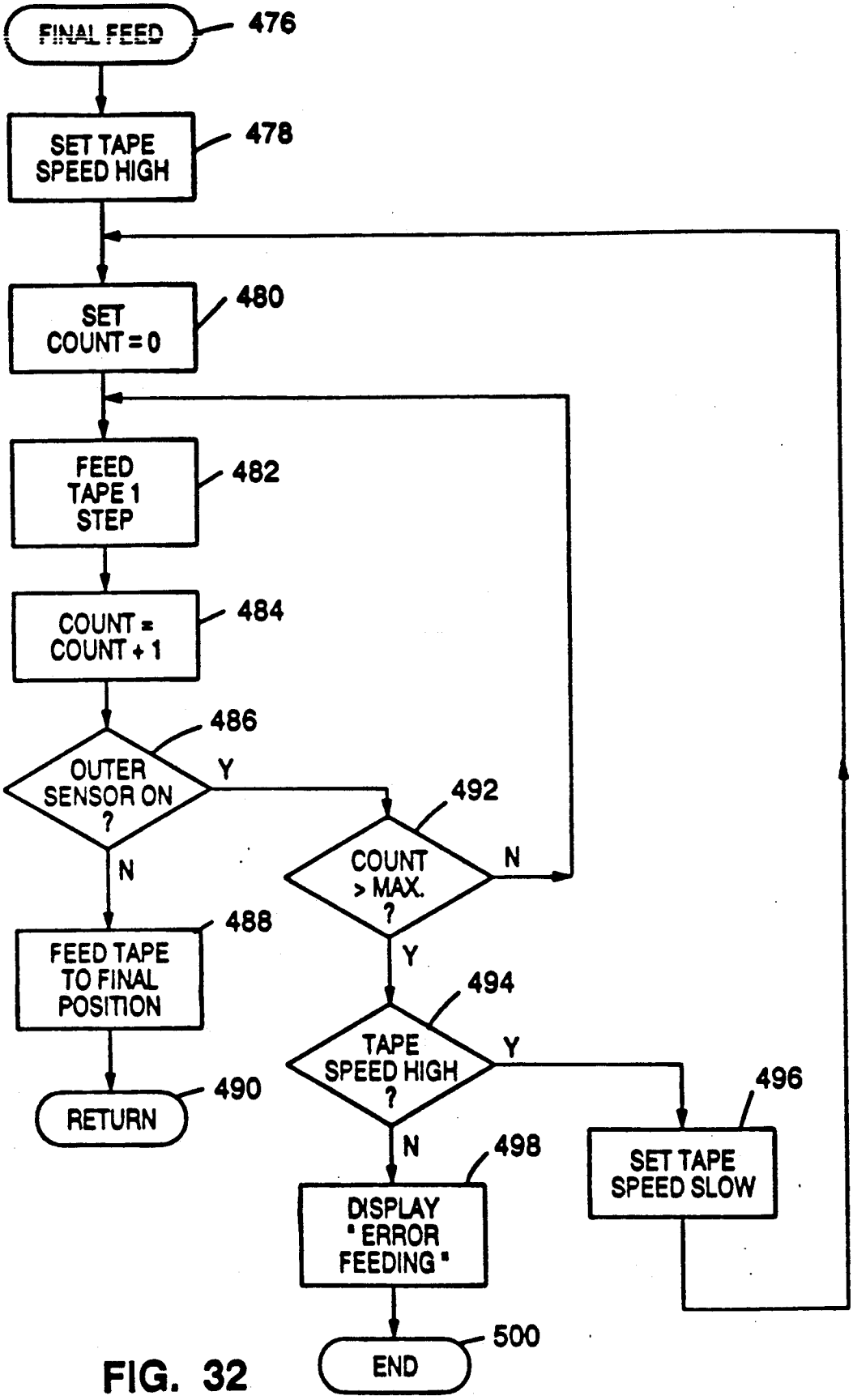
FIG. 32 is a simplified flow chart of the Final Feed subroutine used in the primary software program of FIGS. 26A-26D.

Referring back to the main program at FIG. 26B, as represented by block 282, a "BINDING" message will be displayed indicating that the binding sequence has commenced. A final feed subroutine is then entered as indicated by block 284. The final feed subroutine, which is depicted in FIG. 32, completes the tape feeding sequence.

As indicated by elements 476 and 478 of the final feed subroutine, the tape feed motor 210 is then speeded up so that the remainder of the tape will be quickly fed into the binding apparatus. The change in tape feed speed is illustrated in the FIG. 25A waveform 224 at point 224(*b*). The speed is increased by stepping the motor of a faster rate.

As represented by block 480, a tape feed counter is set to zero. For each motor step, the tape feed counter is incremented, as represented by block 484. The purpose of the counter is to limit the amount of time that the tape feed motor will be permitted to run as high speed. This feature would, for example, cause the motor to eventually drop back to the low speed in the event a partially inserted tape has become lodged in the machine. At low speeds, the motor has a large amount of torque and is less susceptible to being forced out of control by external forces such as a lodged tape. The increased torque also enables the motor to more easily free lodged tapes.

A determination is then made as to whether the end of the tape 32 has been fed past outer tape sensor 184. Assuming that the tape has not yet been fed to this point, outer sensor 184 will continue to sense tape. As represented by elements 486 and 492, the tape feed counter will then be examined to determine whether the maximum count has been reached.

Assuming that the maximum count has not been reached, the sequence returns to block 482 and the motor will advance another step at the fast speed. This sequence will continue until the end of the tape passes sensor 184 and sensor 184 no longer detects tape. At this point, the end of the tape will be located at a fixed position (FIG. 22), just to the left of sensor 184. It is necessary to advance the tape further until the end of the tape coincides with end of book line 178.

As indicated by block 488, the tape is driven a fixed distance, approximately 1 inch and the motor decelerated until the end of the tape comes to rest at line 178. Waveform 224 of FIG. 25, at point 224(*c*) shows the tape feed motor turning off after the tape has been fully fed. The sequence will then return to the main program.

Assuming that, for some reason, the tape feed counter had timed out (element 492), the sequence would have proceeded to element 494. This is an anomalous condition. A determination is made as to whether the tape speed is high. If so, the tape speed is set to slow, as indicated by block 496, and an attempt is made to feed the tape at the slower speed by returning to block 480 of the sequence. If the tape is not successfully fed at the slow speed, elements 498 and 500 indicate that an "ERROR FEEDING" message will be displayed and the binding sequence terminated.

If the tape is properly fed, block 285 of FIG. 26B of the main program indicates that tape feed solenoid 170 will be turned off. This action is depicted by waveform 222 of FIG. 25 at point 222(*b*) and causes the blocking tab 158C to prevent feeding of an additional tape during the remainder of the sequence.

Figure 16:
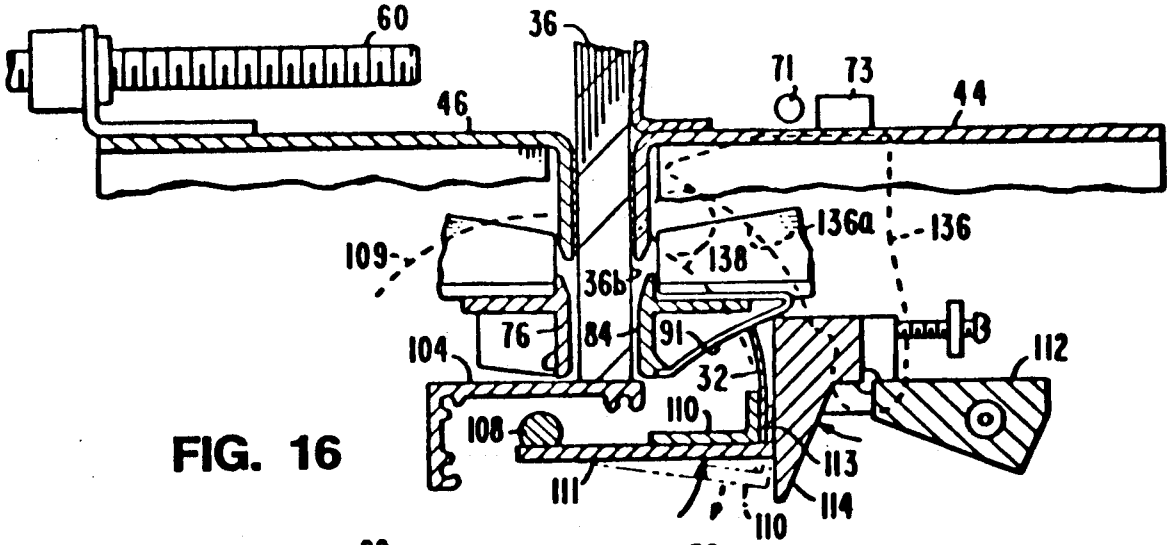
FIG. 16 shows the tape positioner during the initial stages of the binding process wherein the tape positioner is pivoted upwards to ensure that the binding tape is properly loaded in the tape feed bar.

Since the tape is fed into slot 113 of the relatively long tape feed bar, it is possible that the tape will not be seated evenly against the bottom of the slot of the feed bar. In order to ensure that the tape is seated evenly, the tape positioner gear 109 is rotated until the outer edge of the tape contacts the rear cam shoes 91 as shown in FIG. 16. This action tends to force tape 32 completely into slot 113 of the tape feed bar 110 if the tape is not seated correctly.

As indicated by block 286 (FIG. 26B), the positioner gear is rotated so as to seat the tape. The amount of positioner gear rotation required to cause the edge of tape 32 to contact the cam shoes 91 is a function of the width of the tape. Greater rotation is required, for example, in the event a narrow tape is being used in comparison to a wide tape. Waveform 226 of FIG. 25A at point 226(*b*) shows the positioner gear 109 rotated approximately 100 degrees for a narrow tape.

When the positioner gear 109 is rotated, the outer cam bearing 138 (FIG. 16) will engage lower surface 136*a* of lever arm 136. This causes rotating platen 114 to rotate from the horizontal position to a vertical position. This rotation of the platen is depicted in waveform 228 of the FIG. 25A timing diagram at point 228(*a*).

The tape positioner gear 109 is then rotated to the position for forming the first seal between the tape and the book, as indicated by block 288. The first seal is made to the back cover 36*b* of the book (FIG. 16). The exact position of the gear is a function of the measured width of the book and the thickness of the tape being used. A straightforward computation is made based upon the two values so that the tape will be sealed to the back cover 36*b* at the proper distance from the lower edge of the book. The objective is to have equal amounts of tape covering the front and back covers once the binding sequence has been completed.

FIG. 16 shows the tape feed bar 110, in phantom, at the position for accomplishing the first seal. Waveform 226 at point 226(*c*) shows the rotation of tape positioner gear log required to position the tape feed bar at the first seal position.

Next, the carriage assembly is brought to the first seal position as represented by block 290 (FIG. 26B). This is accomplished by driving both the front and rear clamps 46 and 44 rearward as represented by the carriage motor drive waveform 220 at point 220(*a*), the front clamp waveform 216 and the rear clamp waveform 218. The book is driven off the cool platen 104 towards the rotating platen 114, which is still in the vertical position.

Figure 17:
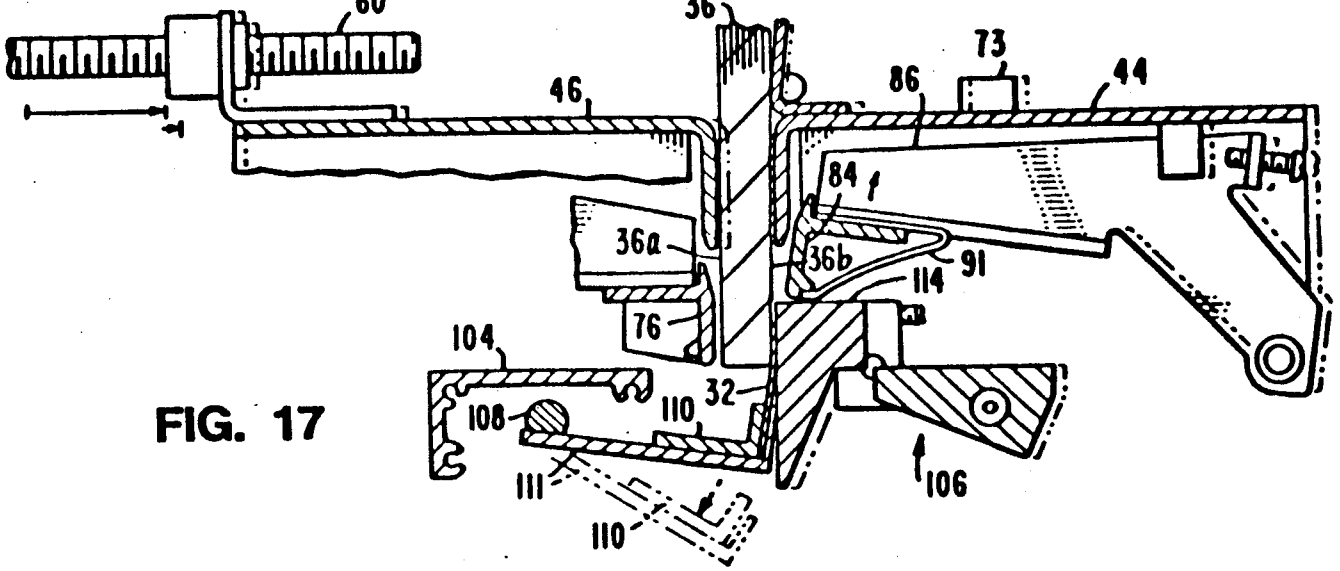
FIG. 17 shows the stage of the binding sequence wherein the seal of the binding tape to the back cover of the book is being formed.

The front and rear backup bars 76 and 84 will move with the front and rear clamps. The rear cam shoe 91 of the rear backup bar will eventually contact the vertical rotating platen 114 and ride up over the platen as shown in FIG. 17. Thus, the rear cam shoes 91 and backup bar 84 will pivot upwards on rear support arm 86 as indicated by waveform 230 at point 230(*a*). At this stage, the edge of tape 32 will be positioned intermediate book 36 and vertical rotating platen 114. The height of the tape relative the to book will be such that equal amounts of tape will extend over the front and back covers of the book once the binding sequence is completed.

The front and rear clamps 46 and 44 continue to drive the book rearward towards rotating platen 114 until the platen is engaged and pressure applied to the platen. As shown in FIG. 7, the moveable platen assembly 106 will be deflected rearward when pressure is applied causing platen springs 134 to expand slightly. This rearward movement is depicted in phantom in FIG. 17. The carriage assembly then stops with both pressure and heat from rotating platen being applied to tape 32. The lower portion of book 36 will deflect slightly towards front backup bar 76. Bar 76 will prevent further movement of the book and will provide support for the book during the first seal.

Just as the first seal begins, the positioner gear 109 is rotated as represented by block 292. This rotation causes the tape feed bar to pivot away from the hot rotating platen 114 so that the bar will not become heated so as to interfere with tape loading during subsequent binding sequences. The rotation of the positioner gear 109, which is depicted at location 226(*d*) of FIG. 25A. The positioner is rotated such that the rotating platen will remain in the vertical position when the book is subsequently backed off.

As indicated by block 294, the first seal is formed in about 1 second. During this time, the applied heat and pressure is sufficient to cause the high tack, heat-activated adhesive strip 32*b* disposed between the back cover 36*b* and the tape substrate 32*a* to form a bond.

Figures 18, 19A, 19B, 19C:
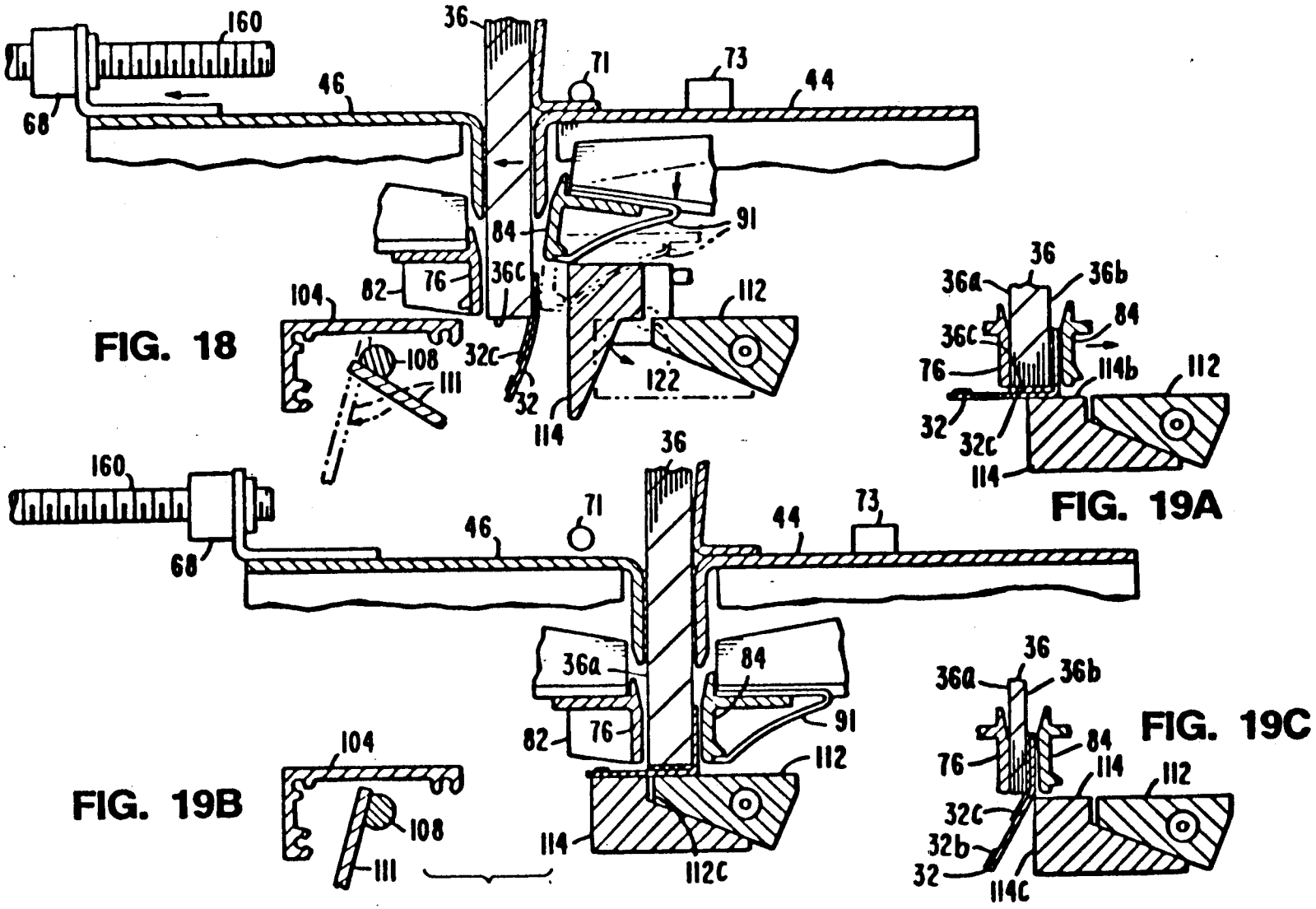
FIG. 18 shows the stage of the binding sequence immediately following the formation of the first seal, with the book being backed away from the heated platen.
FIG. 19A shows the stage of the binding sequence just after the rotating platen has been rotated to a horizontal position and the book has been translated towards the heated platen to the over platen position which causes the binding tape to fold under the book.
FIG. 19B shows the stage of the binding sequence where the book has been translated from the over platen position (FIG. 19A) to the fold position.
FIG. 19C shows the melt to fold stage of the binding sequence for very thin books, which is intermediate the over platen position (FIG. 19A) and the over platen position (FIG. 19B).

As indicated by block 296, once the first seal has been formed, the carriage assembly is pulled forward as shown in FIG. 18. This is accomplished by momentarily driving the carriage drive motor in the forward direction, as indicated by waveform 220 in FIG. 25A at point 220(*b*). The binding tape 32 is exclusively supported by book 36 at this stage.

In the next stage of the sequence, the binding tape will be folded under book 36 by rotating platen 114 so that the low viscosity central adhesive strip 32*c* will contact the lower edge 36*c* of the book which will form the spine. In order to permit the rotating platen 114 to pass under the book, it is necessary to first pull the platen down slightly to accommodate the thickness of the binding tape 32.

As represented by block 298, the tape positioner gear 109 goes to a pull down position. The gear is rotated back to the home position and slightly past the home position so that inner cam bearing 142 (FIG. 7) will engage the upper surface 136*b* of lever arm 136, thereby forcing platen assembly 106 down slightly. At this point the rotating platen will be pivoted to the horizontal position, as indicated in the waveform 228 at point 228(*b*). The location of positioner gear 109 in the pull down position is shown at point 226(*e*) of waveform 226 in FIG. 25A.

For books that are relatively thin, less than about 1/16 inch thick, it is preferable that a few preliminary steps be carried out to facilitate the remainder of the binding sequence. Accordingly, as represented by element 300, a determination is made as to whether the book is thin. Assuming that the book is not thin, the carriage assembly is driven rearward to an over platen position, as represented by block 310.

FIG. 19A shows the position of book 36 relative to platens 114 and 112 when the carriage is in the over platen position. The book 36 is carried rearward over platen 114, with the force the platen causing binding tape 32 to fold under spine 36*c* of the book so that the central adhesive 32*c* of the tape will contact spine 36*c* of the book is in the over platen position when the rear cover 36*b* of the book is positioned in the center of surface 114*b* of platen 114.

As indicated by block 312, the tape positioner gear 109 is then rotated from the pull down position (block 298) to the home position, as represented by waveform 226 at point 226(*f*). The carriage drive motor 58 will pause briefly when the tape positioner gear is driven, since the motor controller or CPU 186 is capable of controlling only one motor at a time. This action causes the platen 114 to apply a slight upward force to book 36. The book is then driven further back towards the fold position, as will be described. At this time, a tension will be exerted on binding tape 32, causing the tape to be pulled tightly around the edge of the book.

The carriage assembly will continue to drive book 36 rearward until the book reaches the fold position, as shown by block 314. As can be seen in FIG. 19B, when the book is in the fold position, front cover 36*a* is positioned slightly to the right of front surface 112*c* of platen 112. Thus, the front cover will be slightly to the right of the pivot axis of rotating platen 114. The action required to place the carriage assembly is the fold position is illustrated by the carriage drive motor waveform 220 at point 220(*c*).

Figure 20:
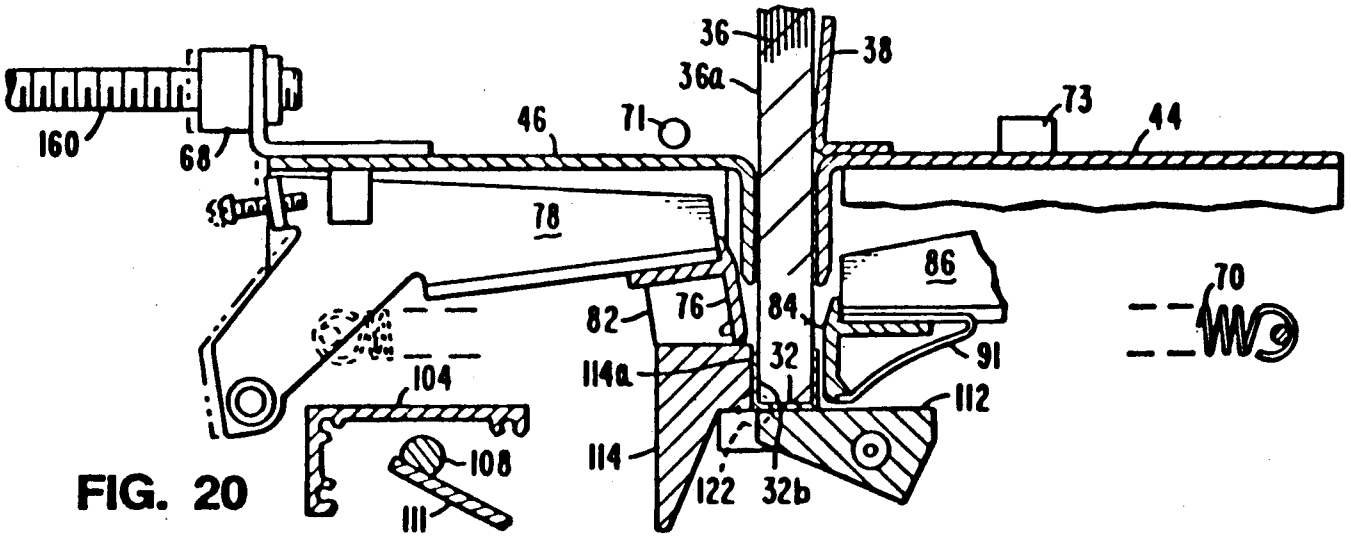
FIG. 20 shows the stage of the binding sequence just after the rotating platen has been rotated to a vertical position so as to fold the binding tape and to effect the seal between, the binding tape and the front cover of the book.

The tape positioner gear 109 is then driven from the home position to a rotate platen position, as represented by block 316. This is shown by waveform 226 at point 226(*g*) of FIG. 25A. This action causes rotating platen 114 to pivot from the horizontal position to the vertical position, as shown in FIG. 20 about pivot pin 122. Also at this time, heat from heated platen 112 will commence melting the central adhesive strip 32C of the binding tape. As indicated by block 318, heat is applied for approximately 7 seconds. The two platens will also apply upward pressure against the book so that both pressure and heat are applied.

When platen 114 rotates during the initial phase of the central adhesive melting period, the platen strikes front cam shoe 82 on front support arm 78. This causes the front backup bar 76 on support arms 78 to pivot upwards away from the path of the platen. Waveforms 228 and 232 illustrate the movement of platen 114 and front cam shoe 82 at points 228(*c*) and 232(*a*), respectively. Rotation of platen 114 causes the binding tape to fold a second time so that the front cover adhesive strip 32*b* will contact the front cover 36*a* of the book.

When the 7 second initial central adhesive melting period is over, block 320 indicates that the carriage assembly is driven slightly in the forward direction as shown in phantom in FIG. 20. This can be seen by waveform 220 at point 220(*d*) of FIG. 25A. The movement forces the book against surface 114*a* of platen 114. Front clamp 46 of the carriage assembly continues to be driven in the forward direction, but rear clamp 44 is restrained from further movement by book 30. The continued movement of forward clamp 46 causes the carriage springs 70 (FIG. 6) to expand slightly, so that platen 114 will apply heat and pressure to the edges of the binding tape.

Rear backup bar 84 provides support for the book when the second seal is formed. In this position, front clamp 46 is no longer engaging the book and the book is free to be forced upward by the platen assembly a distance which corresponds to the thickness of the tape. Thus, the book will be at the proper vertical position for transfer back to cool platen 104, as will be described.

Figure 21:
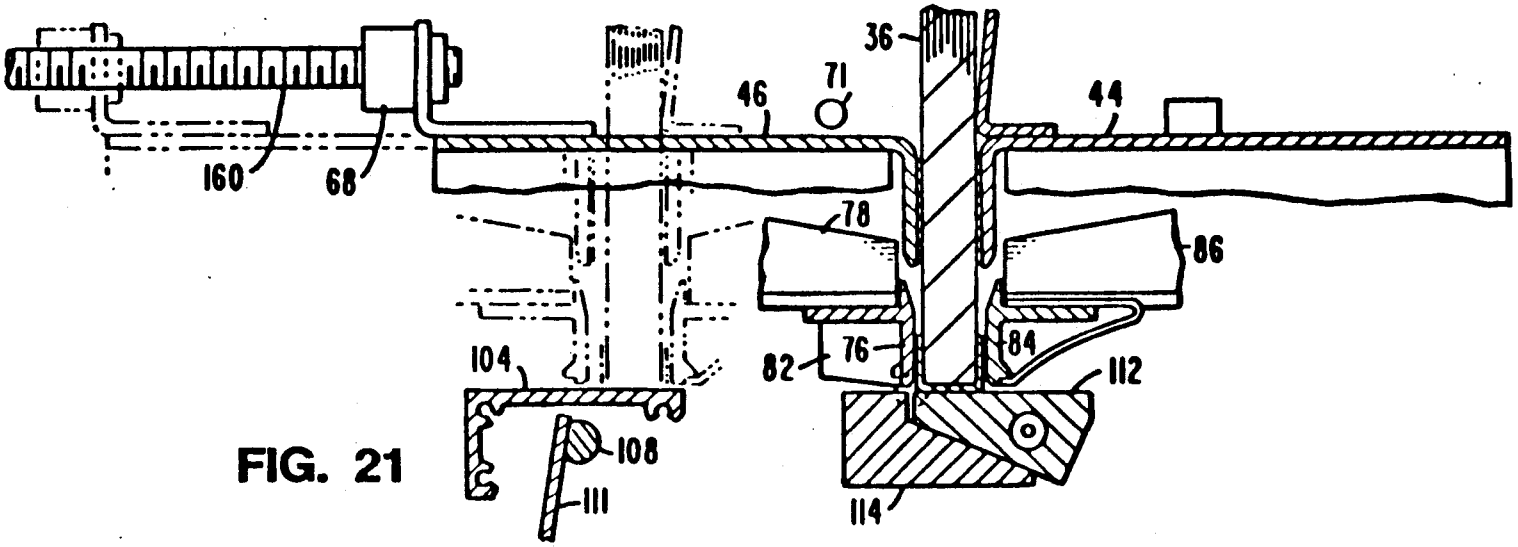
FIG. 21 shows the final stage of the binding sequence wherein the rotating platen is rotated to the horizontal position and the bound book is transferred from the heated platen to the cool platen (in phantom).
Figure 26C:
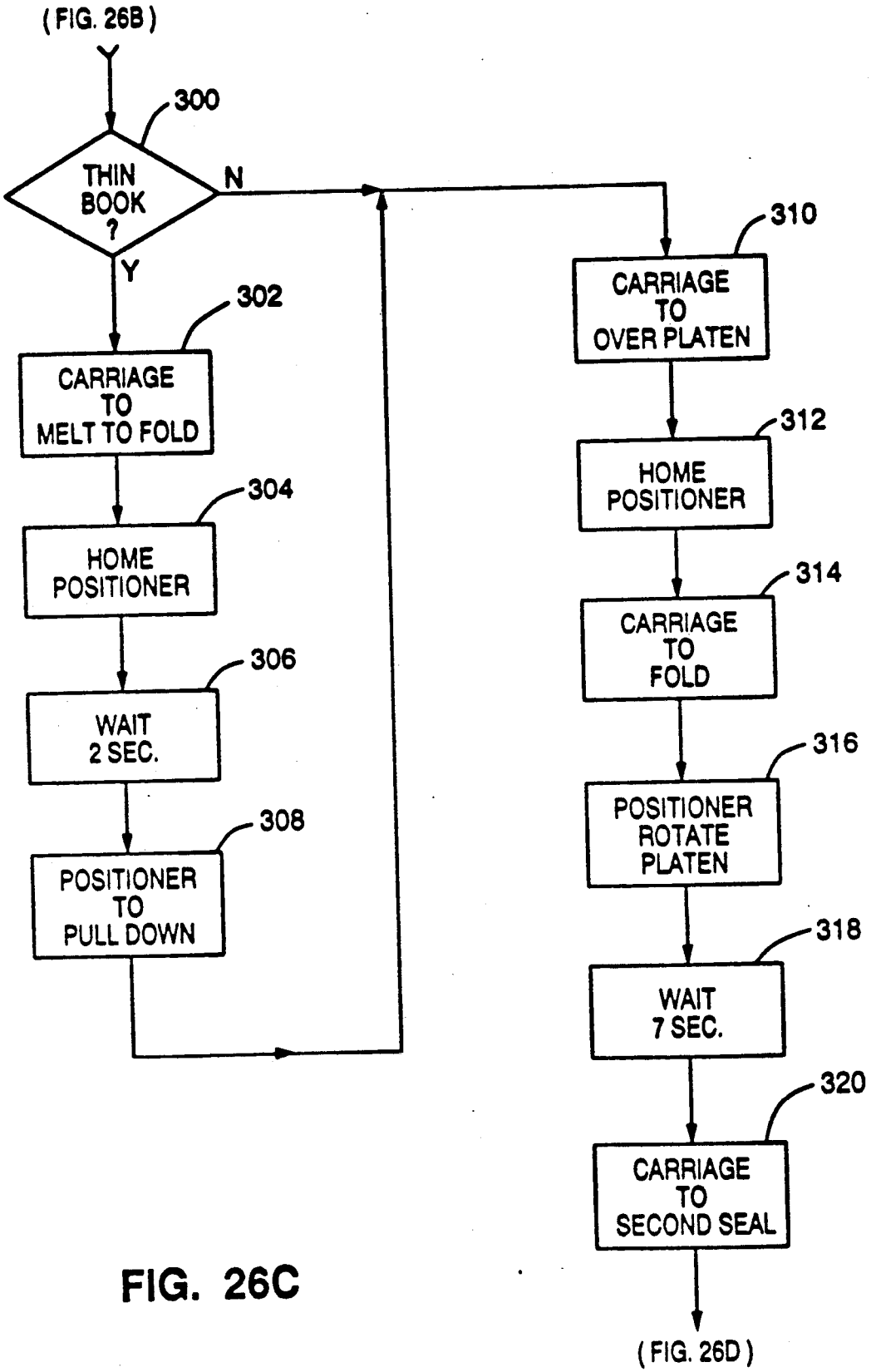
Figure 26D:
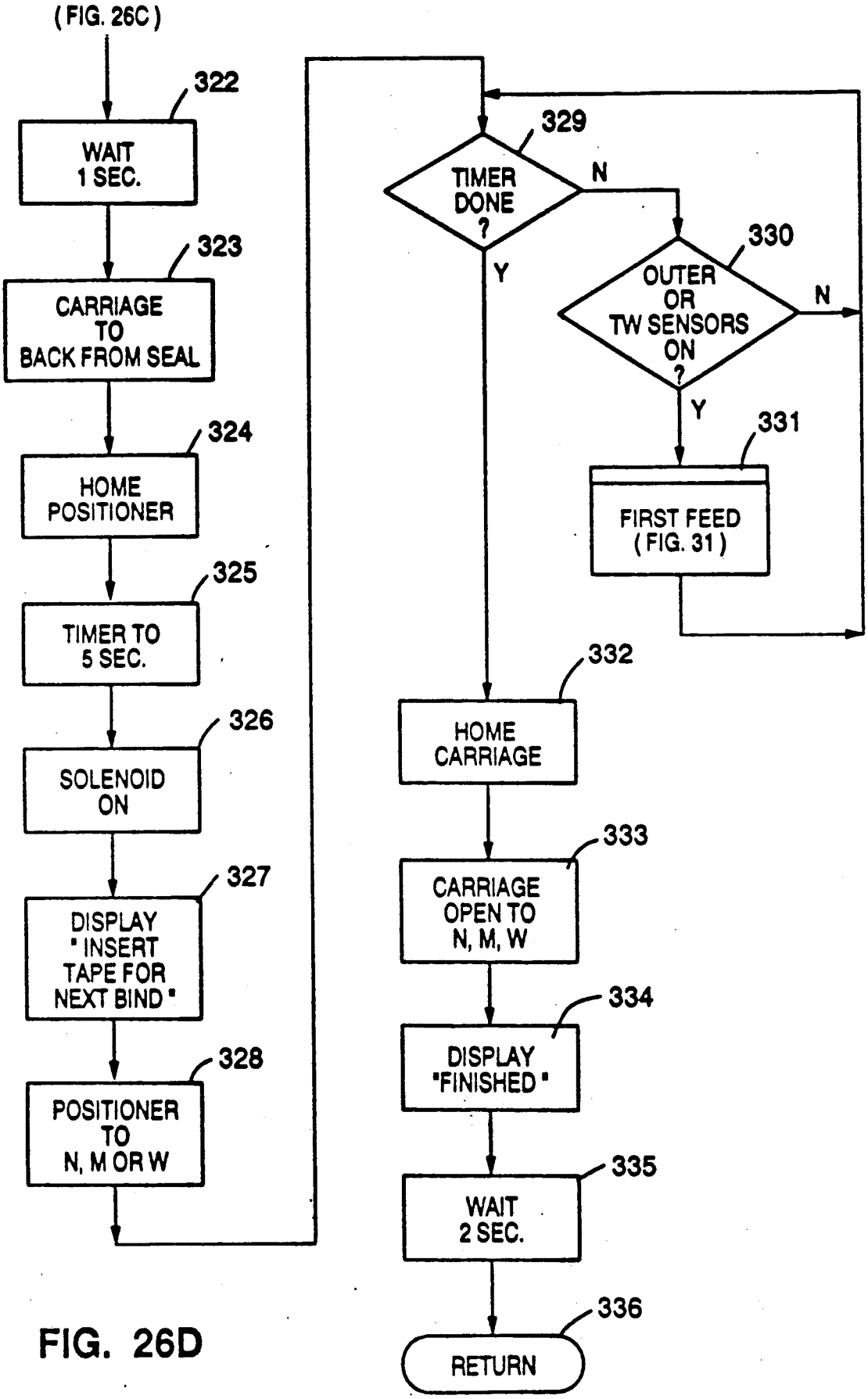

As shown, block 322 of FIG. 26D, heat and pressure are applied for approximately 1 second so as to completely form the second seal. The carriage assembly is then placed in a back from seal position as indicated by block 323 and waveform 220 at point 220(*e*). This is accomplished by driving the assembly a short distance in the rear direction, allowing the front and rear clamps 40 and 44 to again grip book 36, as shown in FIG. 21. The tape positioner gear 109 is then driven back to the home position, as shown by block 324, and waveform 226 at point 226(*h*). This causes rotating platen 114 to pivot to the horizontal position and be reheated by heated platen 112. When platen 114 rotates, front backup bar 76 is free to drop down by the force of gravity. During the process, the central adhesive 32*c* continues to be heated by platen 112. Block 325 indicates that heating of the central adhesive continues for an additional 5 seconds.

At this point in the binding sequence, it is possible to commence loading of a binding tape to be used in the subsequent binding sequence. As indicated by block 326, solenoid 326 is actuated thereby causing the tape guide 158 (FIG. 14) to pivot to the engaged position for tape feeding.

The display 33 will then depict an "Insert Tape For Next Bind" message, prompting the user to insert a tape, as indicated by block 327. The tape positioner will then go to a narrow, medium or wide position, depending upon the width of the tape being presently used, as shown by block 328. As previously described, the tape feed bar 110 and the tape guide 158 then define a tape feed path which corresponds to the width of the tape to be fed.

As shown by element 329, a determination is made as to whether the timer has timed out. If the user elects not to feed a tape for the subsequent bind, the present binding sequence continues. If a tape has been manually inserted before the time out, a determination is made as to whether either the outer tape sensor 184 or the tape width sensor 180 sense the presence of tape. If tape is sensed, the first feed (FIG. 31) subroutine is entered, as indicated by block 331. The tape will become completely fed during the subsequent binding sequence. Assuming that no tape has been inserted or assuming that the first feed subroutine has been completed, the sequence advances to block 332. The remainder of the sequence will be described later.

Returning to element 300, of FIG. 26C, if it is determined that the book is thin, a few preliminary steps will be carried out prior to driving the carriage to the over platen position (block 310). It has been found that there is a tendency for very thin books to be vertically deflected by the upward force exerted on the books when the second seal is formed. This tendency is eliminated if the relatively thick central adhesive strip 32*a* is melted prior to the formation of the second seal. Thicker books have sufficient rigidity to resist the upward force, and therefore, the extra steps are not required.

Assuming that the book is thin, the carriage assembly is driven to a melt to fold position as represented by block 302. (This portion of the sequence is not depicted in the waveforms of FIGS. 25A and 25B.) The tape positioner gear 109 will be in the pull down position, and the carriage assembly will be driven forward thereby causing the rotating platen to engage the binding tape 32 as depicted in FIG. 19C. In this position, rear cover 36*b* is approximately aligned with surface 114*c* of the rotating platen.

As shown by blocks 304 and 306, the tape position is brought from the pull down position to the home position so that platen 114 will rise slightly so as to apply force to the binding tape 32. Heat and pressure are then applied for about 2 seconds so that the central adhesive 32*c* is melted in the region where the first fold is to be made. The tape positioner is then returned to the pull down position, as represented by block 308, thereby removing the applied force. The sequence then returns to block 310 where the remaining binding steps are carried out in the same manner as for a thicker book.

Returning to FIG. 26D, once the second seal has been formed, the carriage assembly is returned to the home position, as indicated by block 332 and point 220(*f*) of waveform 220. Prior to this point, platen 112 continues to apply heat to the central adhesive 32*c* to ensure that the molten adhesive has thoroughly wetted the edges of the sheets which form the book. As shown in phantom in FIG. 21, when in the home position the book is shifted horizontally in the forward direction by front and rear clamps 46 and 44 until the finished book is positioned over cool platen 104. When the carriage assembly is driven to the home position the front and rear clamps 46 and 44 release the book.

The carriage clamps are then opened to either a narrow, medium or wide position, depending upon the thickness of the book which was just bound, as shown by block 333. In the event a thin book is to be bound, the front and rear clamps 44 and 46 provide more support for the book in the open narrow position. This feature also speeds up the binding process for a large number of books of the same thickness since a significant amount of time is required for the clamps to travel from the open wide position to a clamped position for a narrow book.

In the event the next book to be bound is wider than the book just bound, the operator can depress the OPEN button 34*c*. As can be seen by blocks 246 and 248 of the main program flow chart of FIG. 26A, this will cause the carriage assembly to go to the open wide position (FIG. 24D). Finally, as represented by blocks 334, 335 and 336, a "FINISHED" message will be displayed for 2 seconds. This completes the binding sequence. The program then returns to the "Ready" state of the sequence (block 240) of FIG. 20A.

It is possible to edit a book which was previously bound by either adding or deleting sheets. There is, of course, a limit to the number of sheets which can be added to a previously bound book. Referring to the flow chart of FIG. 26A, the control buttons are sequentially scanned as represented by blocks 242, 244 and 246 in the main program flow chart, as shown in FIG. 26A.

In the event a previously bound book is to be edited, the book is placed between the front and rear clamps, and justified to the right. If the clamps are not opened sufficiently wide to accept the book, the operator can depress the OPEN button and the carriage assembly will go to the open wide position, as shown by block 248.

Once the book to be edited has been placed between the clamps, the operator actuates the EDIT button 34*b*. The book is clamped and the thickness of the book is measured (blocks 256 and 260), in the same manner as in an ordinary bind (FIGS. 24A–E). If the book sensor 92 does not sense a book (block 260), the carriage is driven to the open wide position, a "JUSTIFY" message is displayed for about 2–3 seconds, as indicated by blocks 268, 270 and 272.

Assuming that the book has been properly positioned, the eject tape routine is entered for the purpose of removing a tape which may be present in the tape feed bar. The subroutine, which will be described later is represented by block 262.

Assuming further that no tape is present in the machine, solenoid 170 of the tape feed mechanism is turned off (block 264) so that the blocking tab 158*c* is positioned to prevent feeding of tape (FIG. 11). An edit cycle subroutine is then entered, as shown by block 266.

Figure 29:
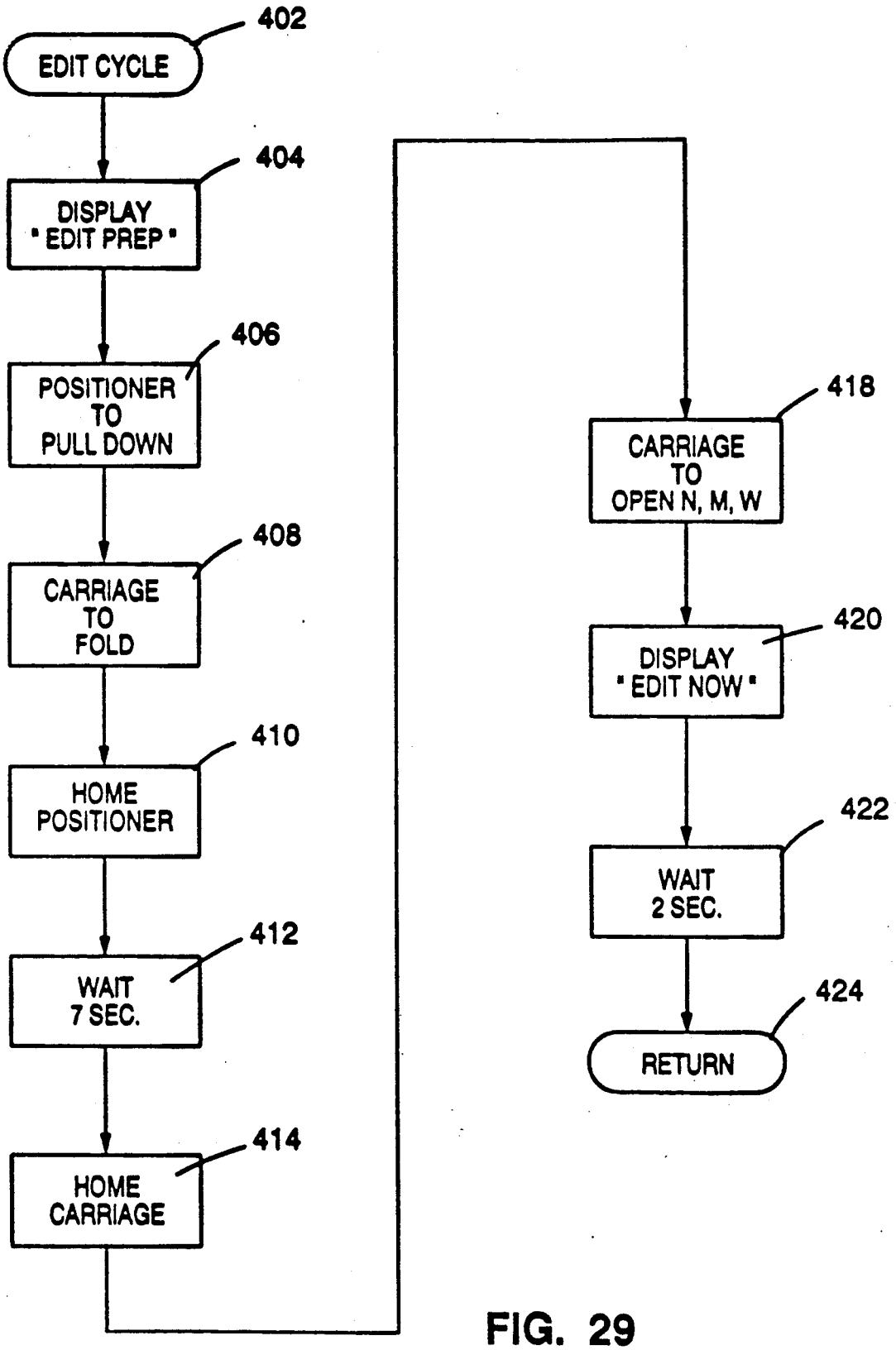
FIG. 29 is a simplified flow chart of the Edit Cycle subroutine used in the primary software program of FIG. 26A-26D.

A flow chart for the edit cycle subroutine is depicted in FIG. 29. As represented by elements 402 and 404, and "EDIT PREP" message is first displayed. This indicates that the preliminary editing steps are to commence. As indicated by block 406, the tape positioner gear 109 is driven to the pull down position whereby the platen assembly 106 is lowered to a position slightly below cool platen 104 on which the bound book is resting. The rotating platen 114 is in the horizontal position. Next, the carriage is brought to the fold position, such as depicted in FIG. 19B, as indicated by block 408. The front and rear clamps 46 and 44 move rearward, transferring the bound book from cool platen 104 to the heating platen 112.

The tape positioner gear 109 is then driven to the home position, as represented by block 410, so that platen 112 will apply an upward force to the book. There is then a 7 second pause (block 412) to permit the central adhesive strip 32*c* to remelt. The carriage assembly is then returned to the home position (block 414) so that the book will return to the cool platen 104.

The carriage is then opened to the narrow, medium or wide position depending on the thickness of the book to be edited as indicated by block 418. An "EDIT NOW" message is then displayed as shown by block 420. The message is displayed for about 2 seconds and the sequence returns to the main program as indicated by block 422 and element 424. At this time, the central adhesive 32C will be melted. The front and rear cover seals will not be effected. The user can then remove one or more sheets from the book by gripping the sheets and pulling the sheets from the book. One or more sheets can be added by placing the sheets at the desired locations and forcing the edges of the sheets into the molten central adhesive. As described below, any added sheets will have to be bound.

At the main program (FIG. 26A), the state of the control buttons is again monitored. If one or more sheets had been added during the edit cycle, the edit cycle is repeated to bind the added pages. This is accomplished by repositioning the book in the carriage and depressing the EDIT button a second time.

Figure 28:
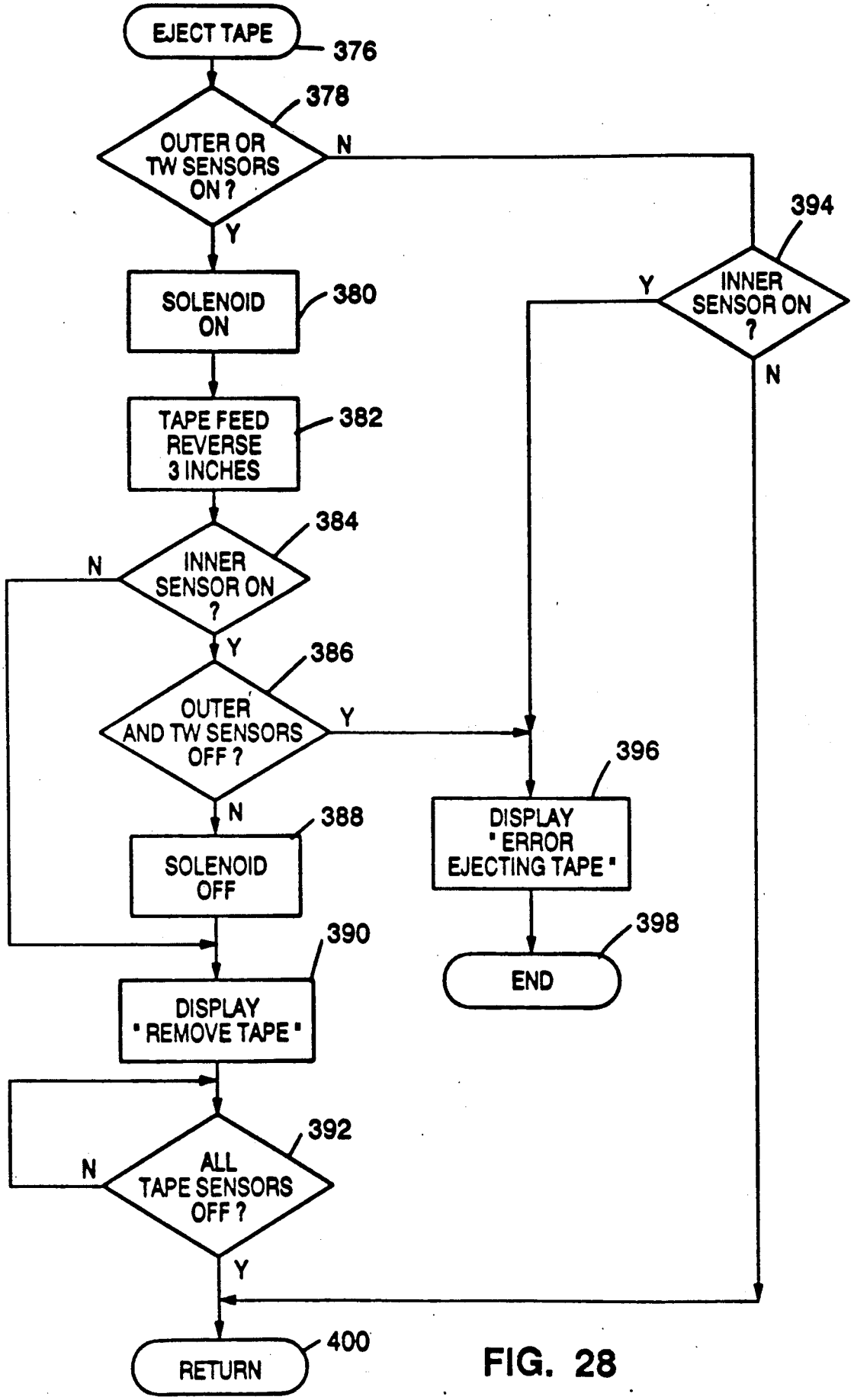
FIG. 28 is a simplified flow chart of the Eject Tape subroutine used in the primary software program of FIGS. 26A-26D and in other subroutines.

The eject tape subroutine, used in the primary program (block 262, FIG. 26A), the start tape subroutine (block 445, FIG. 30) and the initialize subroutine (block 352, FIG. 27A), functions to remove tape that may be present in the binding apparatus. The eject tape subroutine flow chart is shown in FIG. 28. As indicated by elements 376 and 378, a determination is first made as to whether either outer tape sensor 184 (FIG. 22) or tape width sensor 180 detects the presence of tape in feed bar 110. If neither sensor is actuated, a determination is made as to whether the inner tape sensor 182 senses tape (element 394). If no tape is sensed here, there is no tape present, and the sequence returns to the program which called for the subroutine, as indicated by element 400.

Assuming that either or both of sensors 180 and 184 sense tape, the tape feed mechanism solenoid 170 (FIG. 10) is turned on (block 380). When in the tape drive mode, idler roller 160 will engage feed roller 162. The tape feed motor 210 is turned on so as to drive the feed roller 162 in the reverse direction. If a tape has been pinched between rollers 160 and 162, the tape will be driven for approximately 3 inches in the reverse direction. As set forth below, this may cause the end of the tape to protrude out of the apparatus through opening 150 so that the tape can then be manually removed.

A determination is then made as to whether inner sensor 182 senses tape (block 384). If tape is sensed, a determination is made as to Whether both the outer tape sensor 184 and tape width sensor 180 fail to detect the presence of tape, as shown by element 38*b*. If either sensor detects tape, the end of the tape should be protruding from the binding machine so that it can then be manually removed. The tape feed solenoid 170 is turned off so that rollers 160 and 162 release the tape, as indicated by block 388.

As shown by block 390, a "REMOVE TAPE" message is then displayed. Once the tape has been manually removed, none of the tape sensors will detect the presence of tape. As indicated by elements 392 and 400, the sequence will then return to the calling program. The tape can also be manually removed in the event the inner tape sensor does not detect the presence of tape (element 384), while either the outer, tape sensor or the tape width sensor do detect tape (element 378).

In the event the inner sensor 182 detects tape (element 384), but neither outer sensor 184 nor tape width sensor 180 detect tape (element 386), an anomaly has occurred. It is probable that the right end of the tape is so far to the left of sensors 180 and 184 (FIG. 22) that any attempt to remove the tape by reversing the tape feed drive will cause a tape jam. In that event, no attempt will be made to automatically eject the tape. As indicated by blocks 396 and 398, an "ERROR EJECTING TAPE" message will be displayed and the sequence will end. It will be necessary to manually remove the tape. This can be easily accomplished since the moveable platen assembly 106 can be pivoted away from the tape feed bar, as depicted in phantom in FIG. 9B.

Thus, a preferred embodiment of the book binding apparatus has been disclosed. Although the preferred embodiment has been described in some detail, changes can be made by those skilled in the art without departing from the spirit and scope of the invention, as defined by the appended claims.

We claim:

1. Apparatus for binding a plurality of sheets arranged in a stack utilizing a binding tape which includes a flexible tape substrate which carries an adhesive, with the tape being bonded to first and second cover sheets of the stack and engaging an edge of the stack so as to form a spine, said apparatus comprising:

stack support means for supporting the stack of sheets, said stack support means includes a first clamp member for engaging the first cover sheet of the stack and a second clamp member for engaging the second cover sheet of the stack with said first clamp member being movable with respect to said second clamp member;

tape positioner means for positioning the tape with respect to the stack;

platen means for applying the tape to the stack of sheets; and control means for controlling the relative position of said stack support means and said platen means so as to first seal the binding tape to the first cover by application of pressure, with the entire first cover seal being made simultaneously, and to then seal the binding tape to the second cover by application of pressure, with the entire second cover seal also being made simultaneously.

2. The apparatus of claim 1 wherein said support means includes a first backup member mounted movably between a backup position where the first backup member supports the stack when said second cover seal is made and a displaced position displaced from said backup position and a second backup member mounted movably between a backup position where the second backup member supports the stack when said first cover seal is made and a displaced position displaced from said backup position.

3. The apparatus of claim 2 wherein said platen means is also a means for causing said first and second backup members to move between said backup and displaced positions.

4. The apparatus of claim 3 wherein said first and second backup members are mounted on said first and second clamp members, respectively.

5. The apparatus of claim 4 wherein said backup members are pivotally mounted on said clamp members.

6. The apparatus of claim 5 wherein said backup members include cam surfaces which engage said platen means causing said backup members to move from said backup position to said displaced position.

7. The apparatus of claim 6 wherein said backup members move from said displaced position to said engaged position by force of gravity.

8. The apparatus of claim 3 wherein stack support means is also a means for moving the stack between a stack load position and bind position, in response to said control means, and includes a support platen which supports the edge of the stack when the stack is in the load position.

9. The apparatus of claim 8 where said tape positioner means is movable between a tape load position and a first cover seal position where the tape is positioned adjacent the first cover and said control means further controls said tape positioner means so that when said tape positioner means is in said first cover seal position, the location of the tape with respect to the first cover is a function of the thickness of the stack.

10. The apparatus of claim 9 wherein said control means makes said first cover seal by causing said stack support means to move the stack from said stack load position to said bind position, by causing said tape position to move from said tape load position to said first cover seal position so that the tape will be intermediate said first cover and said platen means and then causing said stack support means to force the stack against the tape and said platen means thereby making said first cover seal.

11. The apparatus of claim 10 wherein said control means makes said second cover seal subsequent to making said first cover seal by causing said stack support means to move the stack with respect to said platen means so that said platen means will fold the tape around the edge of the stack and over the second cover and then cause said stack support means to force the stack against the tape and said platen means thereby making said second cover seal.

12. The apparatus of claim 11 wherein said platen means includes a first platen and a second platen movable with respect to said first platen between a cover seal position and a fold position.

13. The apparatus of claim 12 wherein said control means covers said second platen to move to said cover seal position when said first and second cover seals are made and to said fold position when the tape is folded around the edge of the stack.

14. The apparatus of claim 13 wherein the control means causes said second platen to move between said cover seal position and said fold position by way of said tape positioner means.

15. The apparatus of claim 14 wherein said tape positioner means includes a tape support member which supports the tape along a first edge so that tape adhesive for forming the first cover seal at a second edge of the tape is exposed to said platen means.

16. The apparatus of claim 15 wherein said tape positioner means includes a tape positioner shaft and a support arm which connects said tape support member to said tape positioner shaft and said tape positioner means is moved from said tape load position to said first cover seal position by rotation of said tape positioner shaft.

17. The apparatus of claim 16 wherein said tape support member moves through an arc having a radius which is equal to the length of said support arm.

18. The apparatus of claim 7 wherein the tape adhesive is a heat actuated adhesive and said first platen is a heated platen.

19. The apparatus of claim 18 wherein said first platen is electrically heated and said second platen is heated by said first platen through thermal conduction.

20. The apparatus of claim 19 wherein said second platen is heated by said first platen when said second platen is in said fold position.

21. Apparatus for binding a plurality of sheets arranged in a stack utilizing a binding tape which includes a flexible tape substrate which carries an adhesive, with the tape being bonded to first and second cover sheets of the stack and engaging an edge of the stack so as to form a spine, said apparatus comprising:

stack support means for supporting the stack of sheets, wherein said support means includes a first clamp member for engaging the first cover sheet of the stack and a second clamp member for engaging the second cover sheet of the stack, with said first clamp member being movable with respect to said second clamp member, a first backup member mounted movably between a backup position where the first backup member supports the stack when said second cover seal is made and a displaced position displaced from said backup position and a second backup member mounted movably between a backup position where the second backup member supports the stack when said first cover seal is made and a displaced position displaced from said backup position;

tape positioner means for positioning the tape with respect to the stack;

first platen means for forcing the tape against the stack so as to form the spine;

second platen means for forcing the tape against the first and second cover sheets with at least one substantially flat platen surface so as to form first and second cover seals, respectively; and control means for controlling said stack support means, said tape positioner means and said first and second platen means so as to form the spine, first cover seal and second cover seal, with the first and second cover seals being formed at different times.

22. The apparatus of claim 21 wherein said second platen means is also a means for causing said first and second backup members to move between said backup and displaced positions.

23. The apparatus of claim 22 wherein said first and second backup members are mounted on said first and second clamp members, respectively.

24. The apparatus of claim 23 wherein said backup members are pivotally mounted on said clamp members.

25. The apparatus of claim 24 wherein said backup members include cam surfaces which engage said first platen means causing said backup members to move from said backup position to said displaced position.

26. The apparatus of claim 25 wherein said backup members move from said displaced position to said engaged position by force of gravity.

27. The apparatus of claim 22 wherein said stack support means is also a means for moving the stack between a stack load position and a bind position, in response to said control means, and includes a support platen which supports the edge of the stack when the stack is in the load position.

28. The apparatus of claim 27 wherein said tape positioner means is movable between a tape load position and a first cover seal position where the tape is positioned adjacent the first cover and said control means further controls said tape positioner means so that when said tape positioner means is in said first cover seal position, the location of the tape with respect to the first cover is a function of the thickness of the stack.

29. The apparatus of claim 21 wherein said stack support means is also a means for moving the stack between a stack load position and a bind position, in response to said control means, and includes a support platen which supports the edge of the stack when the stack is in the load position, and wherein said control means is also a means for controlling said stack support means so that the book is moved back to said stack load positions subsequent to the formation of the spine, first cover seal and second cover seal.

30. The apparatus of claim 29 wherein said control means controls said stack support means so that the edge of the stack is aligned with a supporting surface of said support platen subsequent to the formation of the spine, first cover seal and second cover seal.

31. The apparatus of claim 30 wherein said stack support means includes a first clamp member for engaging the first cover sheet of the stack and a second clamp member for engaging the second cover of the stack, with said first clamp member being moveable with respect to said second clamp member.

32. The apparatus of claim 31 wherein said control means also controls said first platen means and causes the edge of the stack to be aligned with said supporting surface by causing said first and second clamp members to release the stack and causing said first platen means to move the stack into the aligned position.

33. The apparatus of claim 21 wherein said control means includes a single drive motor for driving said tape positioner means, and said first and second platen means.

34. The apparatus of claim 33 wherein second platen means is pivotably mounted with respect to said first platen means and wherein said control means includes a positioner gear driven by said single drive motor, with said positioner gear coupled to said tape positioner means, said positioner gear including a pair of spaced-apart cam bearings and said control means further including a lever arm coupled to said second platen means with said lever arm including a pair of cam bearing surfaces for engaging said pair of cam bearings of said positioner gear so that said second platen means can be pivoted with respect to said first platen means when one of said cam bearings engages one of said cam surfaces and so that said second platen means is shifted to a pull down position when the other of said cam bearings engages the other of said cam surfaces subsequent to the formation of the first cover seal and prior to the formation of the spine.

35. A method of binding a plurality of sheets arranged in a stack utilizing a flexible tape substrate which carries an adhesive, said method comprising the following steps:

supporting the stack of sheets;

forming a first cover seal by forcing said tape against a first cover sheet of the stack utilizing a substantially flat platen;

folding the tape around an edge of the stack after the first cover seal is formed; and forming a second cover seal after the tape is folded by forcing the tape against a second cover sheet of the stack utilizing a substantially flat platen.

36. The method of claim 35 wherein the entire said first cover seal is formed substantially simultaneously.

37. The method of claim 36 wherein the entire said second cover seal is formed substantially simultaneously.

38. The method of claim 37 wherein said step of folding the tape is carried out utilizing said platen used for forming said first cover seal.

39. The method of claim 38 wherein said steps of forming said first and second cover seals and said step of folding are carried out utilizing a single platen and wherein said platen is moveable between a cover seal position and a fold position and said steps of forming the first and second cover seals are carried out with said platen in said cover seal position and said step of folding the tape is carried out with said platen in said fold position.

40. The method of claim 39 wherein the steps of forming the first and second cover seals and the step of folding the tape are carried out under the control of a processor unit.

41. The method of claim 39 wherein the step of forming the first cover seal includes the step of limiting movement of said book by positioning a first backup bar adjacent the second cover opposite said platen and the step of forming the second cover seal incudes the step of positioning the second backup bar adjacent the first cover opposite said platen.

42. The method of claim 41 whereas the step of forming the first cover seal includes the step of removing said second backup bar from adjacent the first cover and the step of forming the second cover seal includes the step of removing said first backup bar from adjacent the second cover.

* * * * *

UNITED STATES PATENT AND TRADEMARK OFFICE

CERTIFICATE OF CORRECTION

PATENT NO. : 5,052,873

DATED : October 1, 1991

INVENTOR(S) : Kevin P. Parker et al.

It is certified that error appears in the above-indentified patent and that said Letters Patent is hereby corrected as shown below:

Column 4, Line 23, replace "32" with --33--.
Column 4, Line 46, replace"32C" with --32A--.
Column 7, Line 23, delete "114".
Column 7, Line 24, after "rotating platen" insert --114--.
Column 11, Line 41 replace "32" with --33--.
Column 11, Line 48, replace "46 and 48" with --44 and 46--.

IN THE CLAIMS
Column 26, Line 47, replace "covers" with --causes--.
Column 27, Line 57, replace "first" with --second--.
Column 28, Line 41, after "wherein" insert --the--.

Signed and Sealed this

Twenty-ninth Day of November, 1994

*Attest:*

Bruce Lehman

BRUCE LEHMAN

*Attesting Officer*

*Commissioner of Patents and Trademarks*